US005605110A

United States Patent [19]

Talbot

[11] Patent Number: 5,605,110

[45] **Date of Patent: *Feb. 25, 1997**

[54] MULTI-USE WATERCRAFT

[75] Inventor: Dennis W. Talbot, Salt Lake City, Utah

[73] Assignee: Aerotrans Corporation, Salt Lake City, Utah

[ * ] Notice: The portion of the term of this patent subsequent to Oct. 11, 2011, has been disclaimed.

[21] Appl. No.: 321,539

[22] Filed: Oct. 11, 1994

Related U.S. Application Data

[63] Continuation-in-part of Ser. No. 97,080, Jul. 22, 1993, Pat. No. 5,353,730.

[51] Int. Cl.[6] ..... B63B 7/04

[52] U.S. Cl. ..... 114/248; 114/39.1; 114/77 R; 440/40; 440/41

[58] Field of Search ..... 114/248, 270, 114/39.1, 246, 77 R, 352, 138, 290; 440/40, 41, 88

[56] References Cited

U.S. PATENT DOCUMENTS

| | | | |
|---|---|---|---|
| 2,644,434 | 7/1953 | Watkins | 440/88 |
| 2,989,939 | 6/1961 | Tatter | 114/290 X |
| 3,082,732 | 3/1963 | Stallman | 440/41 |
| 3,238,911 | 3/1966 | Pazulski | 114/39.1 |
| 3,291,088 | 12/1966 | Klose | 114/39.1 |
| 3,347,201 | 10/1967 | Szabo | 114/248 |
| 3,422,785 | 1/1969 | Strumor | 114/235 |
| 3,659,546 | 5/1972 | Miklos | 114/248 X |
| 3,815,541 | 6/1974 | Hansen | 114/248 |
| 3,842,783 | 10/1974 | Waller et al. | 114/235 |
| 3,844,245 | 10/1974 | Yamaguchi | 114/235 |
| 3,910,219 | 10/1975 | Ono et al. | 114/235 |
| 3,922,993 | 12/1975 | Bludworth | 114/235 |
| 4,223,628 | 10/1980 | Higute et al. | 114/246 |
| 4,326,479 | 4/1982 | Kawasaki | 114/248 |
| 4,337,053 | 6/1982 | Stevens | 440/87 |
| 4,407,214 | 10/1983 | Kawasaki | 114/249 |
| 4,694,770 | 9/1987 | Kitner et al. | 114/123 |
| 5,131,348 | 7/1992 | Roy | 114/363 |
| 5,167,550 | 12/1992 | Nielsen | 440/84 |
| 5,255,625 | 10/1993 | Hattori | 114/248 |
| 5,353,730 | 10/1994 | Talbot | 114/248 |
| 5,388,544 | 2/1995 | Kobayashi | 114/248 |

FOREIGN PATENT DOCUMENTS

| | | | |
|---|---|---|---|
| 404071985 | 3/1992 | Japan | 114/248 |

*Primary Examiner*—Sherman Basinger
*Attorney, Agent, or Firm*—Workman, Nydegger & Seeley

[57] ABSTRACT

A multi-use watercraft wherein one or more bays are formed in the aft portion thereof for respectively docking one or more personal watercraft (PWC). The PWCs are connected to provide propulsion for the multi-use watercraft when so docked in the bay. The multi-use watercraft and the PWCs may be separated and used independently while on the water. The PWCs may also be docked in the bay of the multi-use watercraft while on the water. A scoop proximal to the jet pump nozzle of each PWC is provided to enable the multi-use watercraft to go in the reverse direction. Also provided is the ability to sail the multi-use watercraft. Mast, rudders and dagger board may be installed while on the water thus allowing the multi-use watercraft to use wind for propulsion. The multi-use watercraft may be converted to sailing mode with or without the PWCs being docked. An inboard motor may also power the multi-use watercraft.

17 Claims, 10 Drawing Sheets

MULTI-USE WATERCRAFT

This is a continuation-in-part of United States Patent Application Ser. No. 08/097,080, filed on Jul. 22, 1993, now U.S. Pat. No. 5,353,730.

BACKGROUND

1. Field of the Invention

The present invention relates to multi-use watercraft, sail boating, and personal watercraft. More particularly, the present invention is directed to utilizing personal watercrafts and wind power for propulsion of a multi-use watercraft.

2. Background Art

Water vessels of various types are well known in the art. Although some commercial water vessels, such as barges, rely on other water vessels for propulsion, few if any recreational watercraft do so. Recreational watercraft vary widely, including sail boats, power boats, house boats, fishing boats, and the like. Each of these is typically designed for a single main purpose, such as sailing or power boating, and provides it's own propulsion designed to advance that purpose.

Recently, a new type of recreational watercraft is enjoying increasing popularity. This is the personal watercraft (PWC). Watercraft of this variety are typically inboard Class A boats powered by 2-cycle, 2-cylinder engines, typically at or less than 1000 ccm engine displacement, and are propelled and steered by a jet pump or water jet propulsion via an impeller. Trademarks under which these types of watercraft are marketed include Tigershark, Sea-Doo, Wet Jet, Jet Ski, and Wave Runner, although newer makes and models are frequently introduced. Manufacturers of these PWC associate typically through the Personal Watercraft Industry Association (P.W.I.A.).

PWC of the aforementioned variety accommodate riders in motorcycle-style front and back seating positions, although some makes and models allow side-by-side rider seating. The driver or operator of the PWC steers the watercraft with motorcycle-style handlebars while sitting, kneeling or standing. Multiple passengers are accommodated to ride with the driver. PWC are highly maneuverable and relatively easy to operate. Recreational uses vary from competitive buoy circuit racing to leisure cruising.

While both enjoyable to operate and easy to use, there are certain drawbacks to PWC. Typically, PWC are designed to carry a driver only, although some can carry up to two passengers, making them less enjoyable when taking out a group due to inherent cramped rider seating constraints. Most PWC have low power output, have difficulty towing a water skier, and are limited as to their transportational ability due to limited cargo storage area. By way of example, PWC riders and their cargo must inherently get wet during operation. This further limits the usefulness of the PWC to warm temperature operation and seasonal use. Waterproof cargo storage areas must be provided in the PWC to keep the cargo dry. The PWC riders must stow dry street clothing to change into when their use of the PWC is for transportation, rather than recreational use.

These drawbacks have necessitated the acquisition of both a PWC and a power boat to satisfy the aforementioned multiple utilitarian and recreational needs. For instance, a power boat can carry a number of passengers, transport dry cargo, and allow water skiing, while PWC are utilized for their somewhat limited type of water recreation.

The need to purchase both a power boat and PWC also has disadvantages such as the requirement of a separate means of transportation for each of the power boat and the PWC. Further, purchasing both a power boat and PWC is expensive.

BRIEF SUMMARY AND OBJECTS OF THE INVENTION

One object of the present invention is to provide a multi-use, multi-passenger watercraft which incorporates features and utilities of power boats with one or more PWC, and which may also incorporate features and utilities of a recreational sail boat.

Another object of the present invention is to provide a watercraft that satisfies the dual purposes of utilitarian watercraft transportation as well as personal and group watercraft recreation, while eliminating the need for acquiring both a self-propelled, cargo transporting watercraft and one or more PWC.

A further object of the present invention is to provide a multi-use watercraft which has ample power to pull water-skiers while carrying both cargo and passengers.

Another objective of the present invention is to provide an non-powered watercraft, with an interface system adaptable to a variety of PWC make and models, to enable a PWC to be used to power and direct the non-powered watercraft via the interface system.

A further objective is to provide the capability of reverse direction powered movement in a multi-use watercraft powered by personal watercraft.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

Briefly summarized, the above objects and advantages are realized in a non-powered multi-use watercraft which incorporates one or more bays formed in the aft portion thereof for receivably accepting or docking PWC equal to the number of bays. When the PWC are docked in the bays, control is transferred from the PWC to the multi use watercraft via an interface system. The PWC are then used to provide propulsion and direction for the non-powered multi-use watercraft. Alteratively, the multi-use watercraft can also be self-powered.

The bays are constructed so that they will allow for docking of various makes and models of PWC via adapters. Adapters may be used to conform to the front hull configuration of the PWC being used to the bay configuration. Preferably, the adapter is designed of a lightweight material which can easily be lifted in and out of the bay, respectively, for installation therein and removal therefrom. Alternatively, adapters can be pre-fit on to the front hull configuration of the PWC prior to docking into the bay.

Each bay can have a bottom portion which extends from the aft of the multi-use watercraft approximately half the length of the bay and which conforms the bottom configuration of the PWC to the bottom configuration of the multi-use watercraft. This bottom portion betters the fluid dynamic efficiency between the two integrated watercraft by eliminating the formation of partial vacuums in the flowing water as a result of the separation of the water into parts, also known as cavitation. The bottom portion and the adapter may be part of the same unit. Alternatively, such a bottom portion may be omitted and replaced with means for conforming the front and sides of the bays to the front hull of the PWC.

Linkages, used to transfer control from the PWC to the multi-use watercraft, include a stiff member for connecting to the throttle grip of the PWC so that the handlebars thereof may be pushed or pulled in the desired direction for steering the multi-use watercraft. The stiff member is preferably made of a stiff but lightweight material such as aluminum. When the handlebars of the PWC are pushed or pulled, the jet propulsion port of the PWC is turned which causes the force exerted by water propelled therefrom to turn the multi-use watercraft in the desired direction.

In addition to the steering control, electrical control is also transferred to the multi-use watercraft via another linkage. The other linkage includes electrical controls for starting and stopping the PWC engines, the attitude of the jet nozzle, and a throttle cable. Electric controls are transferred through electrical wiring harnesses. The electrical wiring harnesses must be enclosed in a watertight jacket to avoid electric shock, grounding, and premature weathering.

The multi-use watercraft may also include provisions for allowing sail power. A mast may be receivably mounted on the fore portion of the multi-use watercraft. Rudders may be connectably mounted to the aft portion of the multi-use watercraft. A dagger board may be receivably mounted in a slot provided in the middle portion of the multi-use watercraft between the starboard and port sides. The mast is stabilized using cables which may be connectably mounted fore, aft, port, and starboard on the multi-use watercraft. So rigged, sails may be hoisted on the mast to use wind power for propulsion of the multi-use watercraft. An optional jib may be conventionally rigged as well.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are therefore not to be considered limiting of its scope, the invention in its presently understood best mode for making and using the same will be described with additional specificity and detail through the use of the accompanying drawings in which.

DETAILED DESCRIPTION OF THE PREFERRED EMBODIMENTS

Generally described, the present invention is a watergoing vessel having a boat means for carrying cargo and one or more personal watercraft means for powering the watergoing vessel. By way of illustration of a preferred embodiment of the inventive boat means, FIGS. 1 and 2, respectively, each show a multi-use watercraft, generally indicated at 10 and 110. One example of the personal watercraft means used for powering the water-going vessel is seen in FIGS. 3 and 4, generally indicated as a PWC 100.

The personal watercraft means has a means for intaking a stream of water, and has a means, aft of the water intaking means, for outputting the stream of water that was taken in at the intaking means. A jet pump means is used by the personal watercraft means for pumping the stream of water from the intake means to the outputting means so as to impel the personal watercraft means while floating in the water medium. A power plant means is used for driving the jet pump means.

Figure 3:
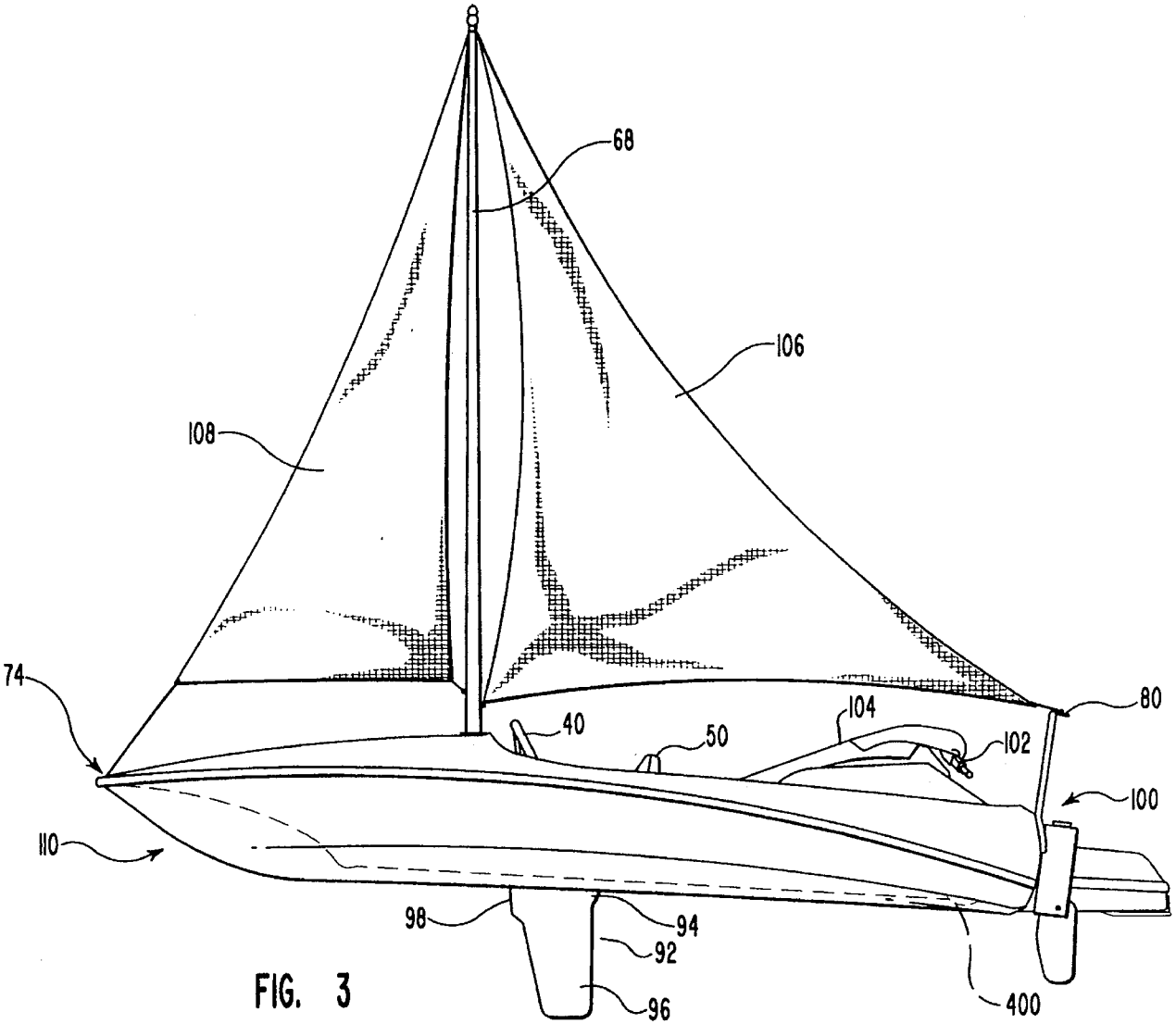
FIG. 3 is a side elevation view showing riggings for the sailing mode of the multi-use watercraft with a PWC docked in the bay thereof.
Figure 4:
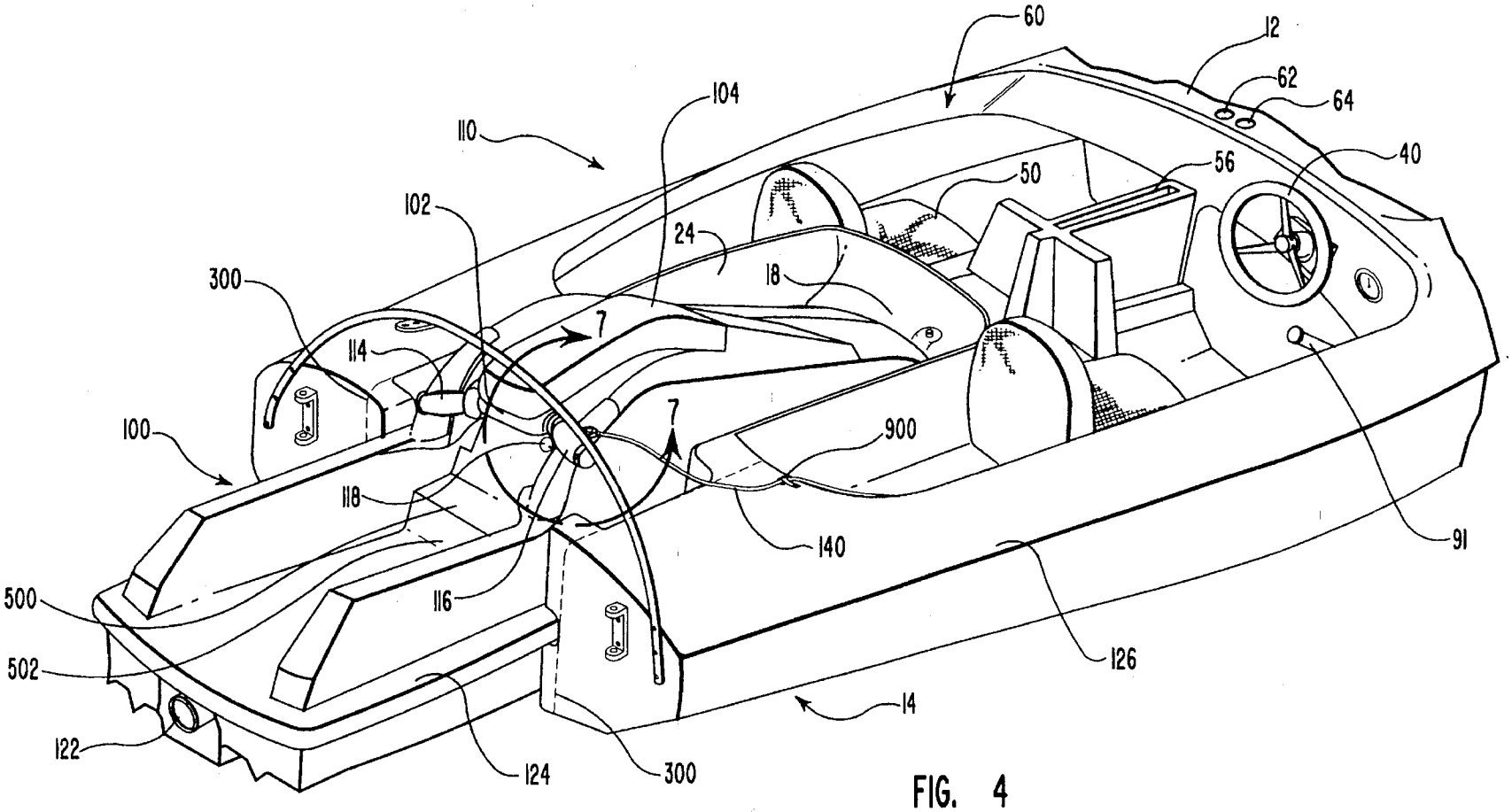
FIG. 4 is a perspective view of the aft portion of a single bay multi-use watercraft showing a PWC docked in the bay thereof.

By way of example and illustration of personal watercraft means components, and as seen in one of FIGS. 3 and 4 there is depicted an intake port 400 as the means for intaking the stream of water. An output port 122 is shown as the means, aft of the water intaking means, for outputting the stream of water that was taken in at the intaking means. Within the external body of PWC 100 is the cooperating and combined devices of a jet pump 502 as the jet pump means used by the personal watercraft means for pumping the stream of water from the intake means to the outputting means so as to impel the personal watercraft means while floating in the water medium, and an engine 500 as an example of the power plant means used for driving the jet pump means.

A handlebar means is used for controlling the angle of the outputting means with respect to both the port and starboard of said personal watercraft means so as to control the impelled direction of the personal watercraft means. Also, a means for controlling the jet pump means is part of the personal watercraft means so as to vary the flow rate of the water stream exiting the outputting means to control the propulsion rate of the personal watercraft means in the water medium. As shown in FIGS. 3, 4, 6 and 7 for the purpose of providing examples and illustrations, a handlebar means is shown as handlebars 102. The output port or jet propulsion port 122 is controlled by handlebars 102 of PWC 100. The direction of jet propulsion port 122 is changed by changing the orientation of handlebars 102 so as to turn PWC 100.

PWC 100 has a forward portion 110 and an aft portion 112. Forward portion 110 has a yoke 104 mounted thereon. Handlebars 102 are part of yoke 104. Handlebars 102 include port grip 114 and starboard grip 116. As an example of the means for controlling the jet pump means, a thumb throttle 118 is mounted on starboard grip 116 of handlebars 102. Thumb throttle 118 may be linked to the throttle lever 91 by control cabling 120.

Some PWC have a mechanism which urges yoke 104 upward so that it requires less energy for the user to hold yoke 104 up while steering PWC 100. If such a PWC is being used as the propulsion unit of the multi-use watercraft, it may be desirable to attach a strap over yoke 104 of PWC 100 to hold it in a down position. Such a strap could be attached to the boat means or on PWC 100 itself. This strap would keep yoke 104 from bouncing around during use of the multi-use watercraft. However, it is not necessary to proper operation of the multi-use watercraft.

Figure 1:
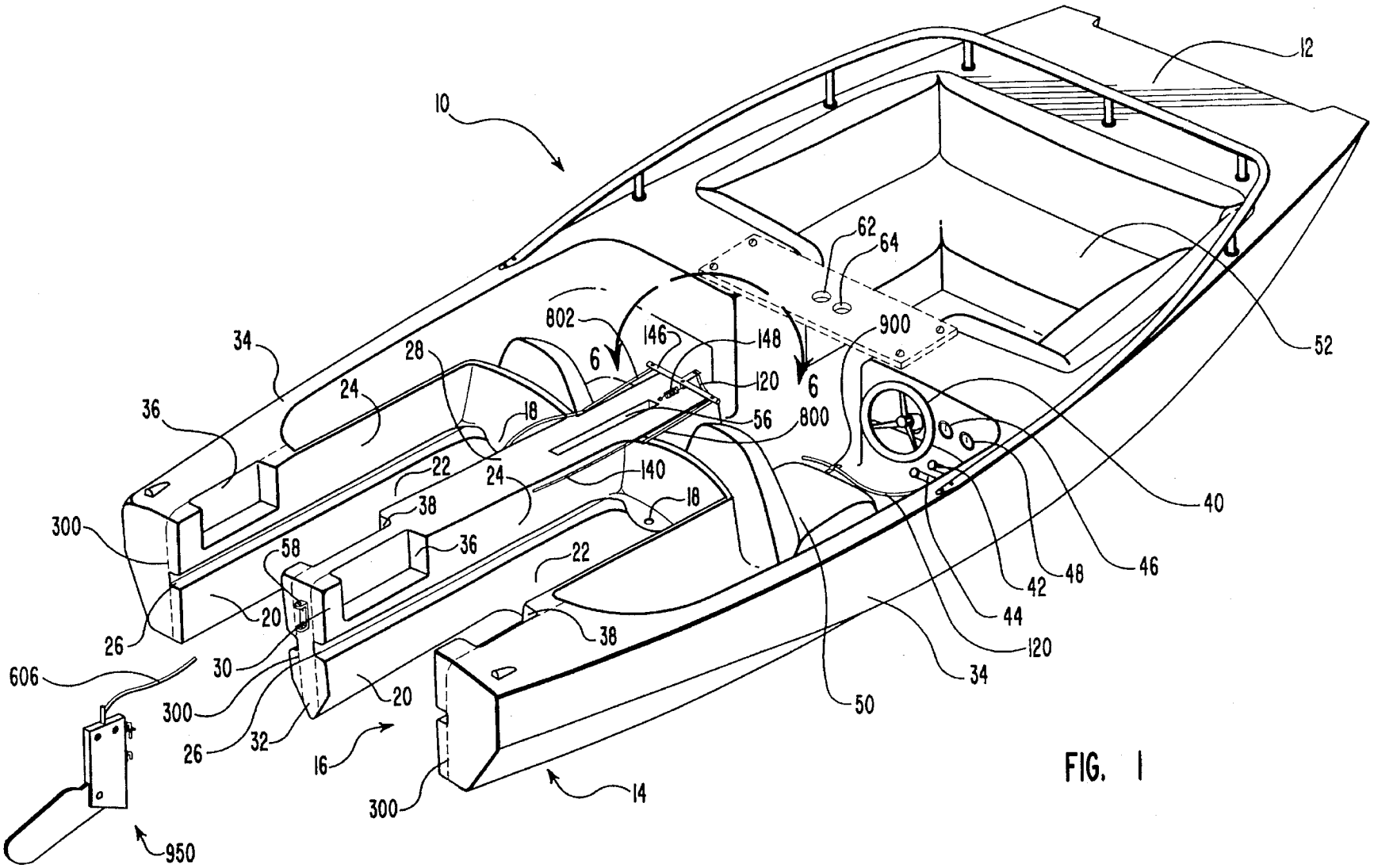
FIG. 1 is a perspective view showing a dual bay multi-use watercraft.
Figure 2:
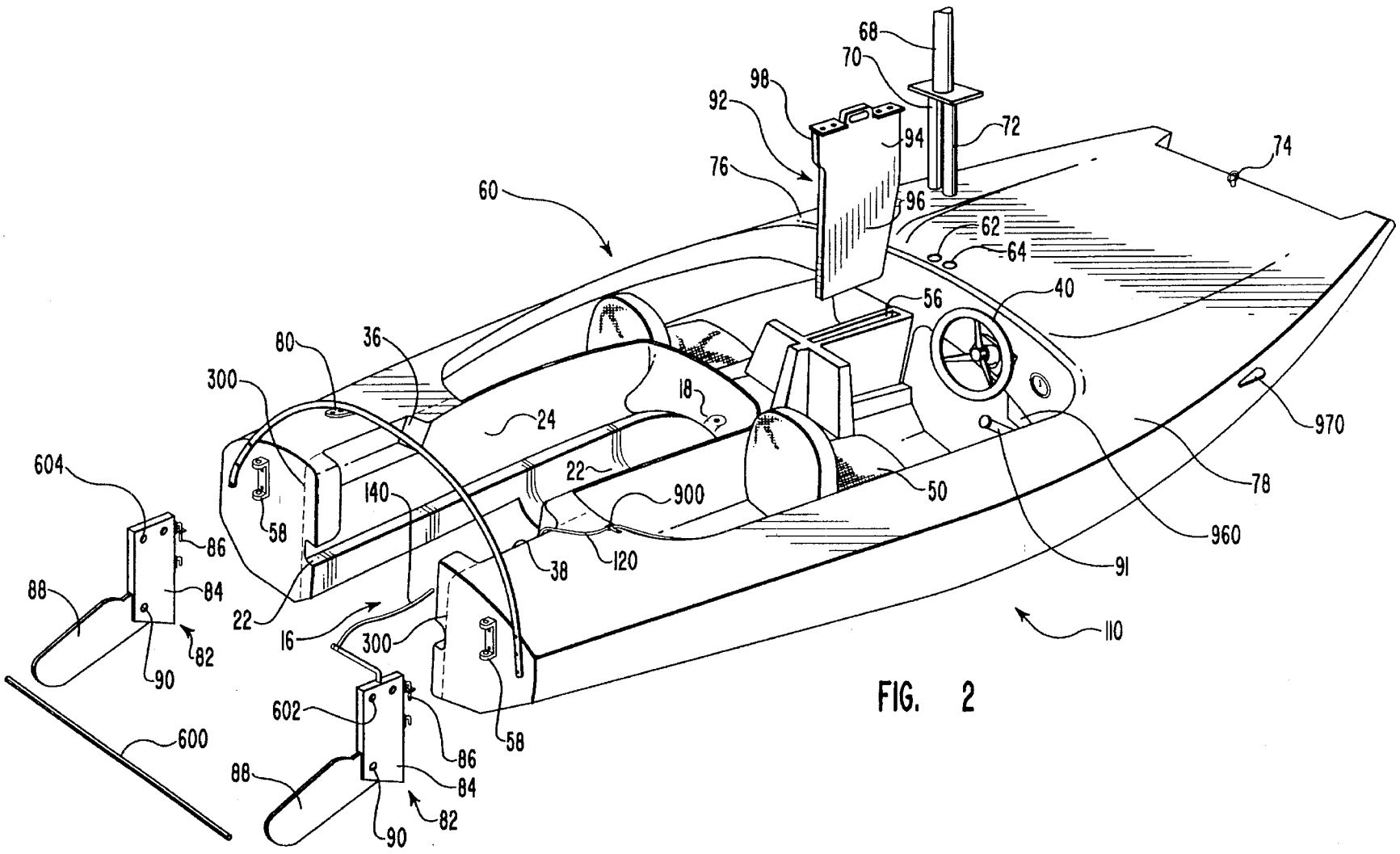
FIG. 2 is a perspective view showing an alternative embodiment of the multi-use watercraft having a single bay.

The boat means has a top side with a cargo area which carries cargo of passengers, packages, and the like, and also includes a docking means for slidably receiving and at least in part circumscribes a portion of the hull configuration of the personal watercraft means. The docking means includes a means for maintaining the intake means of the personal watercraft means in the water medium while the water vessel is underway and also includes a releasable attachment means for holding the hull configuration of the personal watercraft means within said docking means. FIGS. 1 and 2 show respective examples of the docking means by two and one bay 16 embodiments, with FIG. 1 accommodating two PWC (not shown) and FIG. 2 accommodating one PWC (not shown) via bays 16. FIGS. 3 and 4 show by example how bay 16 slidably receives and at least in part circumscribes a portion of the hull configuration of the personal watercraft means, in which an example of the personal watercraft means is generally indicated by PWC 100.

Multi-use watercraft 10, 110 have a bow or forward portion 12 and a stern or aft portion 14. Aft portion 14 of multi-use watercraft 10, 110 have bays 16 formed therein for receivably accepting, or docking, PWC 100 as seen in FIG. 4. Bays 16 have a forward portion 18 and a rear portion 20. Forward portion 18 is curved, and is in effect a recessed area, to allow for at least in part circumscribing a portion of the hull configuration of PWC 100 and to allow for better conformance between the surface of each bay 16 and the hull of PWC 100. The cargo area is generally indicated at 60.

As mentioned, the boat means has a means for maintaining the intake means of the personal watercraft means in the water medium while the water vessel is underway. As an example of the means for maintaining the intake means in the water medium, FIGS. 2 and 3 illustrate that at the bottom of forward portion 18 of bay 16, there is a plate 22 for conforming the bottom of PWC 100 to the bottom of multi-use watercraft 110. Such a plate may also be incorporated in the two bay embodiment of FIG. 1. This helps to ensure proper fluid dynamics of multi-use watercraft 10, 110 with respect to PWC 100 when PWC 100 is docked in bay 16. Plate 22 extends approximately half the length of bay 16. Plate 22 functions to set the attitude of PWC 100 such that intake port 400 is essentially under water at all probable vessel knots and sea conditions when PWC 100 is docked in bay 100. When intake port 400 is kept under water, jet pump 500 is provided with a constant stream of water to pump due to plate 22, rather than a stream of water which is interrupted by vacuum or air pocket intake. The constant supply of water to jet pump 500 prevents cavitation and ensures smoother operation. Preferably, the configuration of plate 22 has tolerances with respect to the hull of PWC 100 such that PWC 100 can be easily ridden into place in bay 16 while vessel 10, 110 is either underway or is dead in the water.

Plate 22 has a trailing edge extending from one side to the other of the docking means. The docking means has a forward portion therein. When the hull configuration of the personal watercraft is received within the docking means such that the bow of the personal watercraft is in contact with the forward portion of the docking means, the plate is in contact with and supports a portion of the keel configuration of the personal watercraft and the trailing edge is located forward of the intake port of the personal watercraft.

Figure 5:
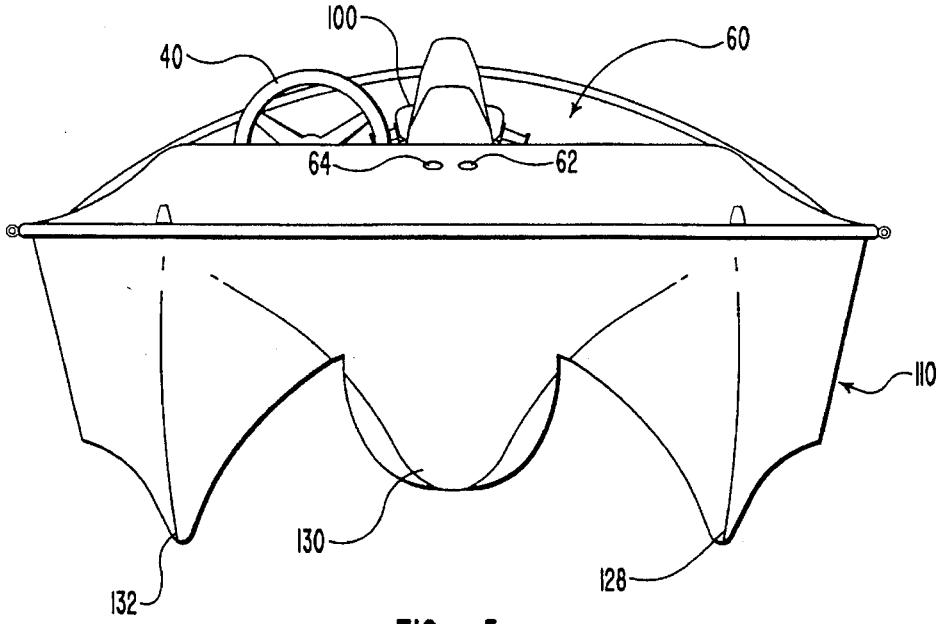
FIG. 5 is a front view showing an example of a hull configuration of a single bay multi-use watercraft.

FIG. 5 illustrates a presently preferred design of hull 126 of the single bay multi-use watercraft 110. A three hull design is utilized including a port hull 128, a mid hull 130, and a starboard hull 132. The mid hull 130 is formed as part of plate 22 and betters the fluid dynamic efficiency between the two integrated watercraft by eliminating vacuums or air pockets in the flowing water as a result of the separation of the water into parts, also known as cavitation. This design allows for conformance between the bottom of multi-use watercraft 10, 110 and the bottom of PWC 100.

Figure 8:
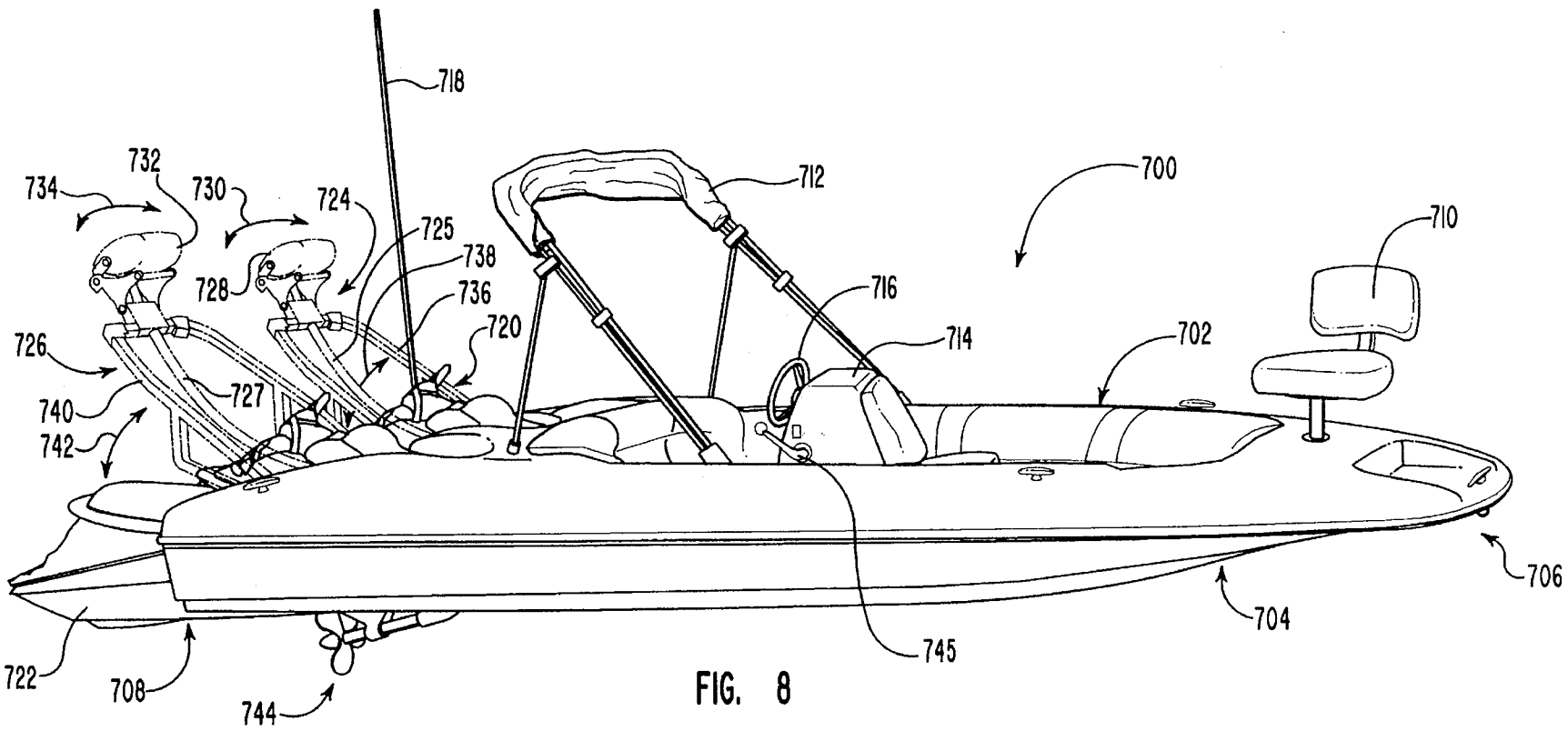
FIG. 8 is a perspective view showing another embodiment of a dual bay multi-use watercraft having two PWC docked in the bays thereof, and having a reverse lock down assembly associated with each PWC, the multi-use watercraft also having auxiliary power from a power plant and propeller drive train.
Figure 9:
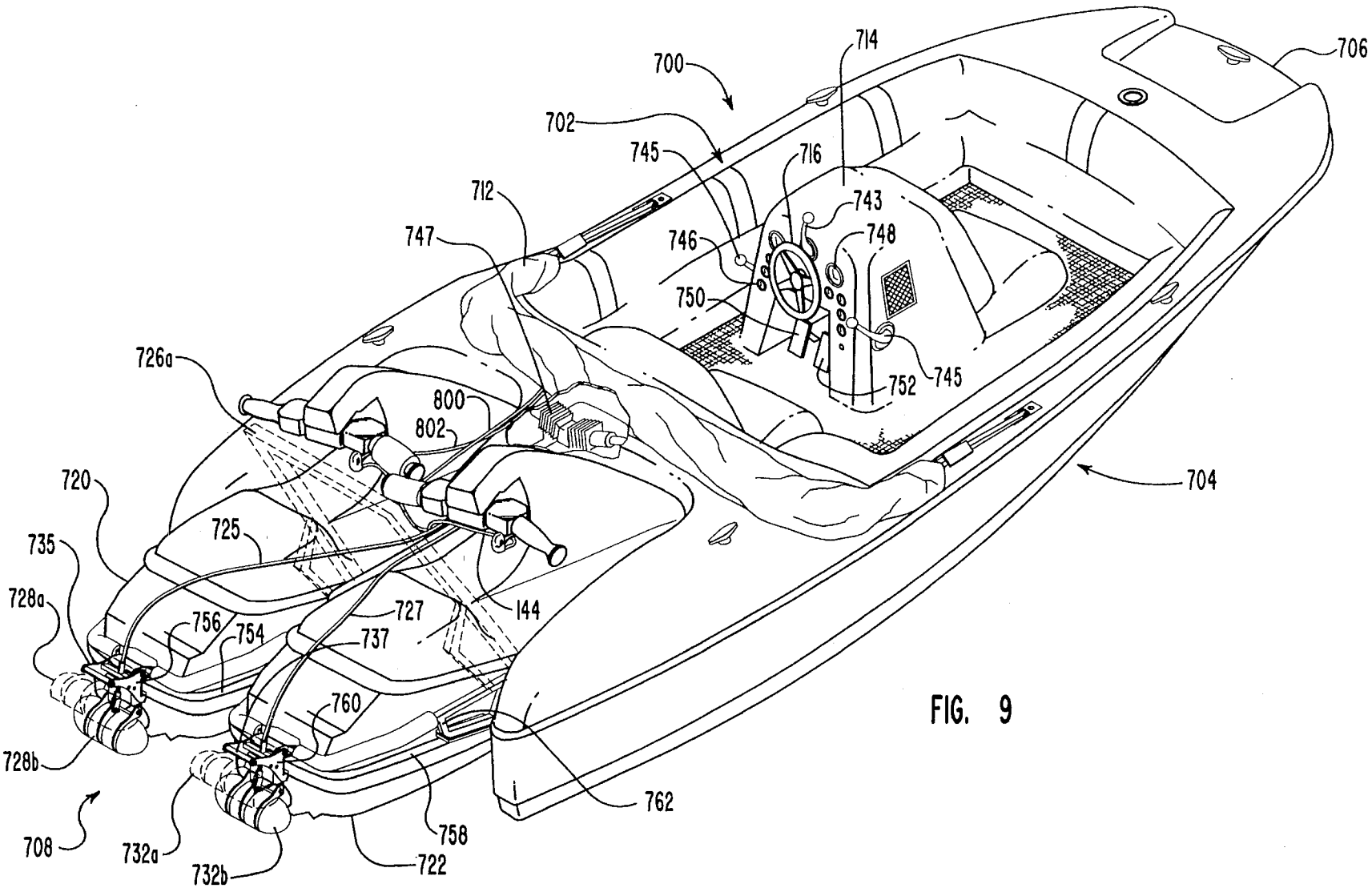
FIG. 9 is a perspective view of a dual bay multi-use watercraft showing the lock down reverse assembly for each of two PWC in the dual bay of the multi-use watercraft, with the lock down reverse assemblies in the down position, with one of the lock down reverse assembly shown in phantom in the up position.
Figure 10:
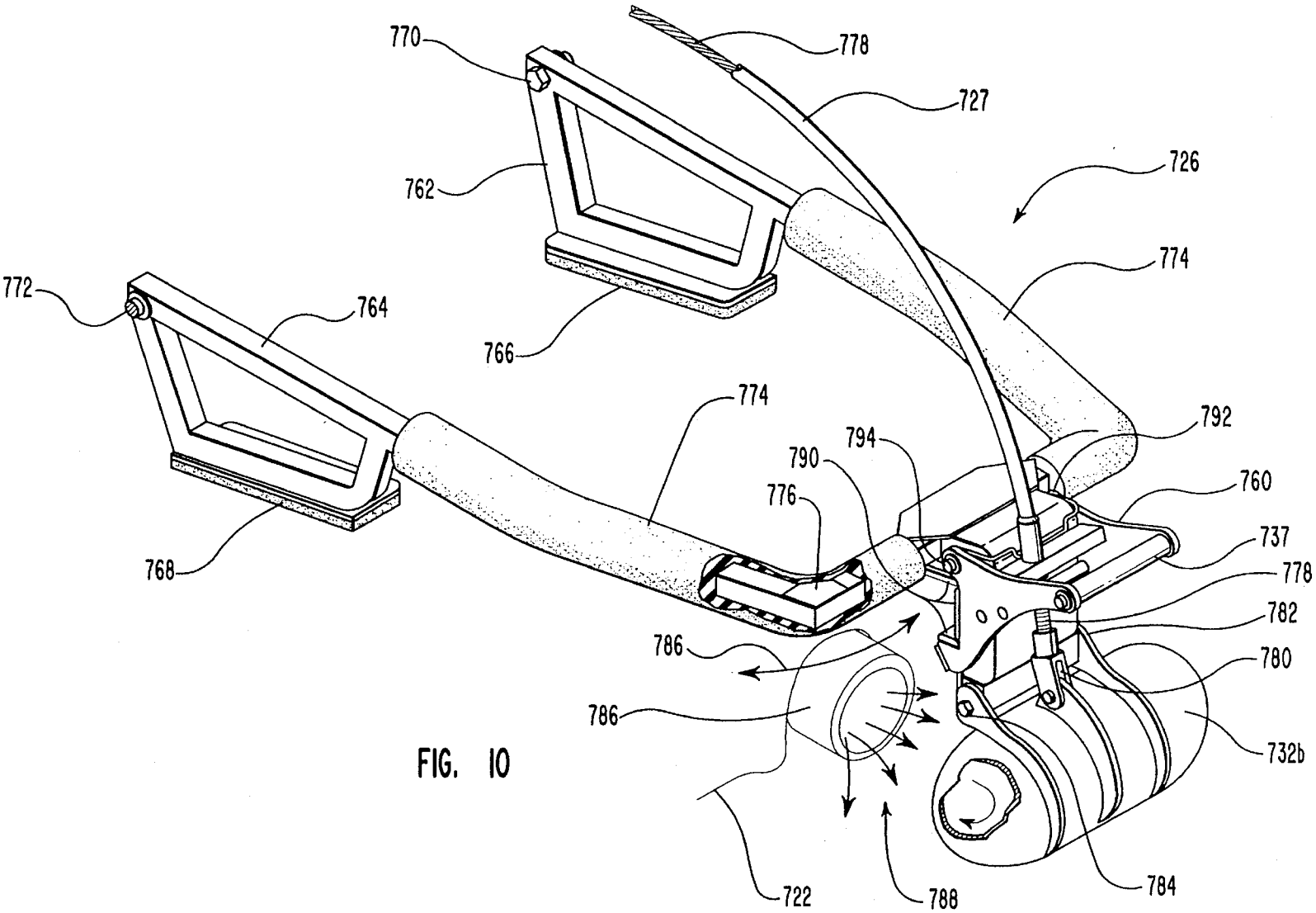
FIG. 10 is a perspective view of a lock down reverse assembly with a reverse scoop in the down position and showing directional arrows of water exiting a jet pump nozzle, which water from the nozzle is directed towards the reverse scoop.

It will be appreciated that other hull designs may be utilized, some of which lack a plate 22 within the bay configuration. The preferred feature in such other hull designs is the interfaced ability to conform the bottom of each of the personal watercraft to achieve proper hydrodynamics by incorporating into the boat means a means for maintaining the intake means of the personal watercraft means in the water medium while the water vessel is underway. Other examples of a means for maintaining the intake means of the personal watercraft means in the water medium while the water vessel is underway are contemplated, such as the inclusion of clamps or locks at stern 14 of vessels 10, 110 so as to maintain the attitude of the personal watercraft means with intake port 400 submerged at all probable knots and sea conditions. One such embodiment is seen in FIGS. 8–10 and is discussed below. Such other embodiments, so designed to minimize cavitation of the waterstream entering the intake means of the personal watercraft means, are within the contemplation of the present invention and are thus considered equivalents.

Each bay 16 has walls 24. Walls 24 of forward portion 18 are curved to receive the hull of PWC 100. Walls 24 may also have a groove 26 formed therein for receiving a gunnel 124 which may be located on the circumference of PWC 100. Groove 26 is illustrated approximately halfway up wall 24 of bay 16. It will be appreciated that both groove 26 and front portion 18 may vary in size or position between makes and models of PWC. FIG. 4 depicts gunnel 124 of PWC 100 as received in groove 26 formed in wall 24 of bay 16. As previously noted groove 26 may be re-positioned, enlarged, or eliminated depending on the desired fit.

Since the size and shape of the hull of the personal watercraft means differ between both makes and models, the stern of the multi-use watercraft can have a recessed area in the stern and an adapter means, situated on an external surface of the recessed area, for cushioning and making an interface of conforming fit between the hull configuration of the personal watercraft means and the recessed area. Thus, vessels 110 and 10 can accommodate various makes and models of personal watercraft, and vessel 10 could accommodate two different makes and models of personal watercraft means via properly sized adapter means. By way of illustration of the adapter means, FIGS. 1, 2, and 4 show foam pads 300 which can be used to conform and mate PWC 100 to bay 16. Alternatively, foam pads 300 could also be replaced by layered shim strips sculpted within bay 16 and generally layered on top of front portion 18, walls 24 and plate 22 to conformingly fit the hull configuration of PWC 100 so as to accomplish the same function.

The adapter means may also be one or more pieces of material set in the recessed area or bay to accomplish a similar function. Alteratively, the adapter means may be eliminated by designing bay 16 to fit the particular make and model of a desired PWC. Of course, the adapter means need not accommodate groove 26 if the PWC being utilized does not have a gunnel. Other methods and means accomplishing functionally similar adaptations are considered equivalents.

Although the dual bay embodiment of the present invention can accept two personal watercraft, an example of which is illustrated and has been described with respect to FIG. 1, it is not necessary to utilize both personal watercraft for propulsion. If required, a single personal watercraft can provide adequate propulsion for the dual bay embodiment. However, it is preferable to use both personal watercraft for propulsion in the dual bay embodiment.

As shown in the dual bay embodiment of vessel 10 in FIG. 1, center portion 28 serves to separate bays 16. Center portion 28 has a top portion 30 and a bottom portion 32. Bottom portion 32 is designed to conform to the overall height of the stern, general designated by 34.

A releasably attachable means is used to lock the PWC to the docking means, an example of which is a hole and spike combination at forward portion 18 which hooks a spike through a hole (not shown) on the bow of PWC 100 (see FIG. 4) so as to retain the bow therein. Other means of retaining the PWC in the docking means are contemplated, and those performing like functions as such are deemed equivalents.

Figure 7:
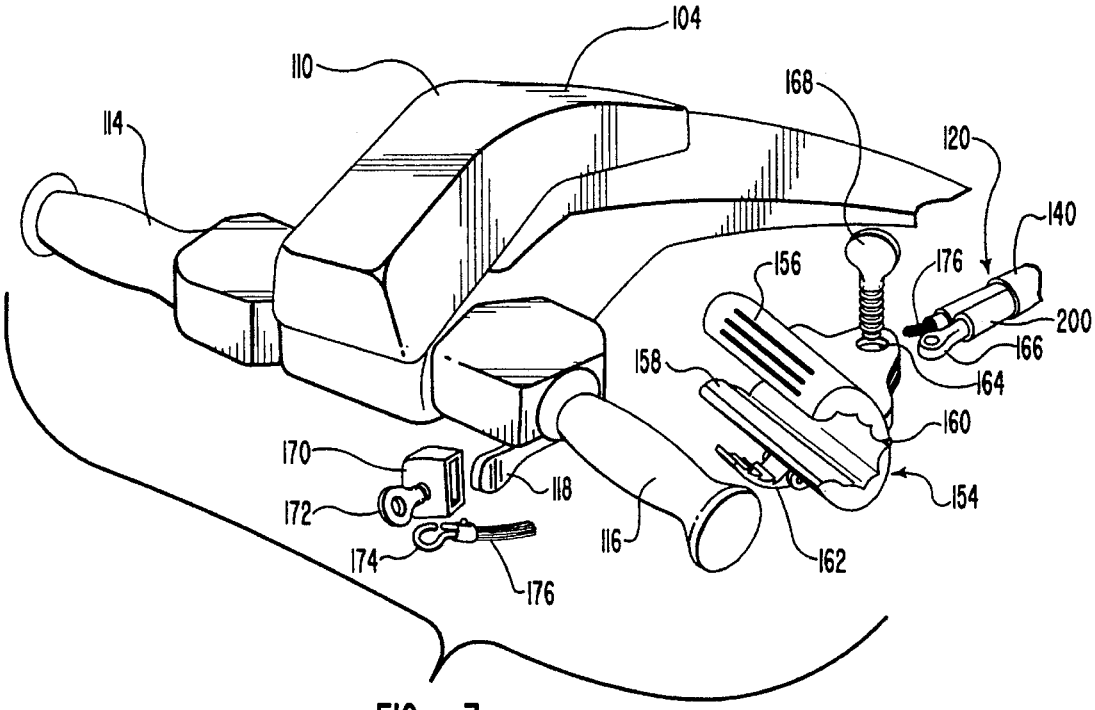
FIG. 7 is an exploded, disassembled view of the handlebars and connections to a thumb throttle configuration and steering grip of the PWC.

Port side cavities 36 and starboard cavities 38 in bays 16 may be formed, if necessary, to allow for free and extended movement of handle bars 102 of PWC 100 (see also, 114, 116 in FIG. 7).

The boat means has a steering means for a user to control the impelled direction of the boat means in the water medium. The steering means includes a user steering interface and a steering linkage means, connected to the handlebar means of the personal watercraft means and also connected to the user steering interface, for moving the handlebar means so as to control the angle of the outputting means.

The boat means also includes a throttle means for a user to control the jet pump means, the throttle means including a user throttle interface and a throttle linkage means, connected to the means for controlling the jet pump means and also connected to the user throttle interface, for moving the means for controlling the jet pump means via the user throttle interface. By way of example and illustration of such means, FIG. 1 shows a throttle lever 42, as the user throttle interface, which controls the port side PWC while the similar throttle lever 44 controls the starboard side PWC. Throttle levers 42 and 44 are linked to the thumb throttles (see generally 118 in FIG. 7, described hereinafter) of PWC 100. FIG. 2 shows a throttle level 91.

An example of the steering means is seen in FIGS. 1, 2, 6 and 7 in which a user steering interface, such as steering wheel 40 of the multi-use watercraft 10, 110, is connected by linking to the handlebars (114, 116 in FIG. 7) of PWC 100. Steering wheel 40 of multi-use watercraft 10, 110 is connected to an example of the steering linkage means as is illustrated particularly in FIGS. 1, 6, and 7 for the dual bay embodiment and in FIGS. 4 and 7 for the single bay embodiment.

FIGS. 1, 4, 6, and 7 further depict examples, given herein for the purpose of illustration, of both the aforementioned steering means and throttle means with associated linkage means to the personal watercraft means. Both single and double bay embodiments are discussed. Like reference numerals are given for like features of single and dual bay embodiments.

In the dual bay embodiment, control cable 120 is routed from steering wheel 40 through sheath 900 to turning linkage 146, which is preferably mounted on or near the floor of cargo area 60. Control cable 120 contains a throttle cable 176 and also contains a stiff member 200 which enables both a pulling and a pushing force to be exerted. Stiff member 200 articulates or turns linkage 146 so as to move starboard stiff member 800 and port cable 802 to push or pull on handlebar 120 via grips 114, 116 of both PWC 100. This, in turn, changes the direction of the force exerted on multi-use watercraft 10, 110 by output port or jet propulsion port 122 of PWC 100. The change in direction of the force serves to turn multi-use watercraft 110, 10 just as it would turn PWC 100. Spring 148 helps to ease the turning of steering wheel 40 by easing the pulling or pushing of cable 120.

Figure 6:
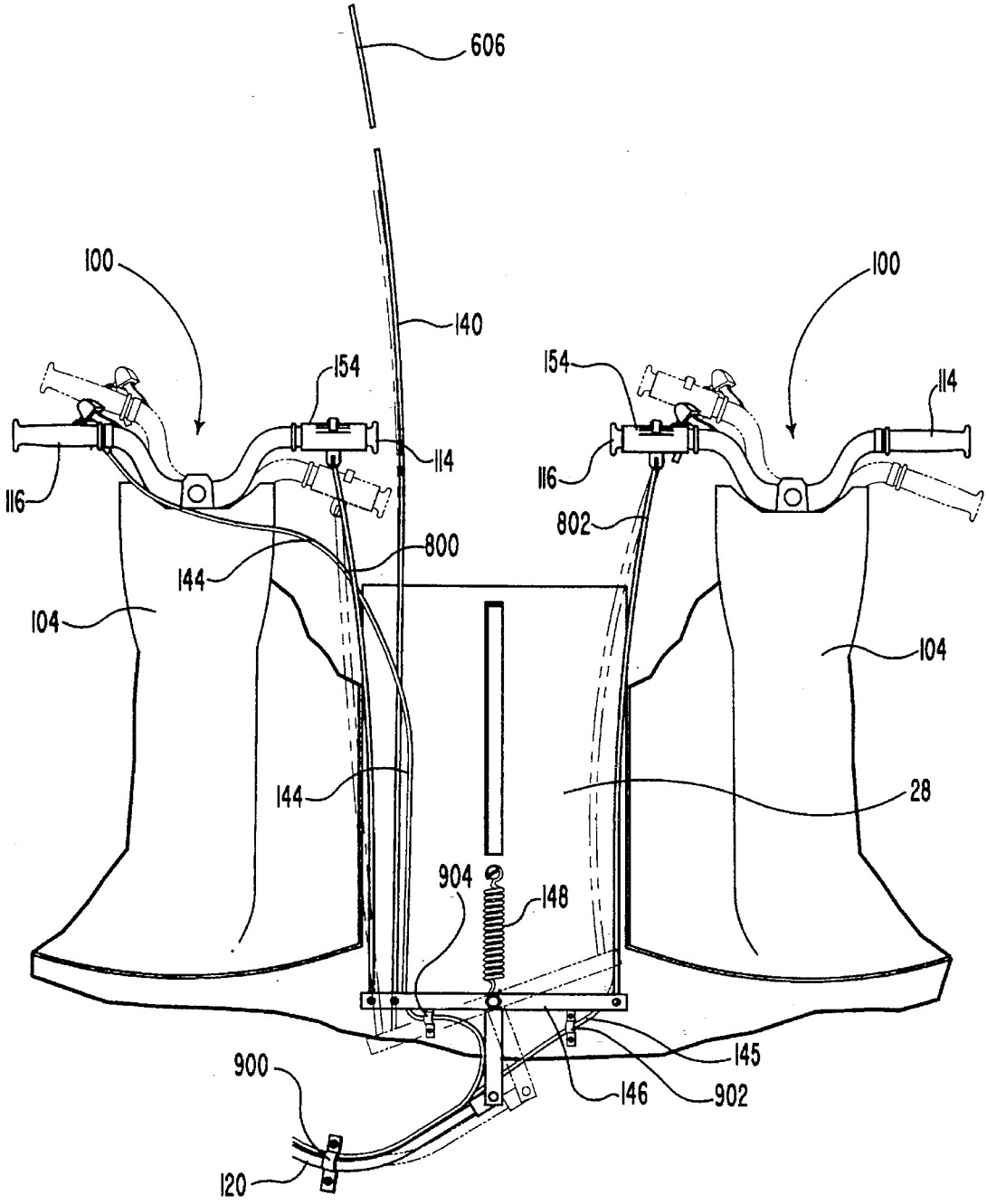
FIG. 6 is a top plan view, as seen from the bow to the stern, illustrating the throttle and steering control cabling which would be utilized in a dual bay multi-use watercraft.

In the dual bay embodiment, and as is more particularly illustrated in FIG. 6, turning linkage 146 connects the port thumb throttle on grip 154 via port cable 802 which is co-axial with the stiff member also in port cable 802. Turning linkage 146 connects the starboard thumb throttle on grip 154 via starboard throttle cable 144, which is not coaxial with stiff member 800. Sheath 902 serves to route port cable 145 and sheath 904 serves to route starboard throttle cable 144. A rudder cable 140 has an end 606 which is connected to a perpendicular member extending from stern rudder 950 in FIG. 1, so as to enable steering wheel 40 to turn rudder 950 via rudder cable 140 and turning linkage 146 while underway in the sailing mode, to be described hereinafter. Rudder cable 140 can be so connected when rudder steering is desired. When rudder steering is not being used, rudder cable 140 may be tucked aside or disconnected.

In the single bay embodiment depicted in FIGS. 2, 4, and 7, control cable 120 is routed from steering wheel 40 through sheath 900 for turning handlebars 102 at starboard grip 116. Control cable 120 contains a throttle cable 176, operatively connected so as to control thumb throttle 118, and also contains stiff member 200 which enables both a pulling and a pushing force to be exerted on handlebars 102 which, in turn, changes the direction of the force exerted on multi-use watercraft 110 by the output port or jet propulsion port 122 of PWC 100. The change in direction of the force of the output water stream serves to turn multi-use watercraft 110 just as it would turn PWC 100. Spring 148 helps to ease the turning of steering wheel 40 by easing of the pulling or pushing of cable 120.

In the single bay embodiment, and as is more particularly illustrated in FIG. 2, control cable 120 extends to form a rudder cable 140 when rudder steering is desired. When rudder steering is not being used rudder cable 140 may be tucked aside or disconnected. Rudder cable 140 can be connected to a perpendicular member extending from the starboard rudder board 82. A rigid cross-member 600 connects the port and starboard rudders 82, which enables movement of them both when the perpendicular extension on the starboard rudder 82 is moved by control cable 120 through sheath 900 via steering wheel 40.

FIGS. 6 and 7 show additional details of the connection of the throttle cabling and steering linkages in the single and dual bay embodiments. A gripping connector 154 is shown attaching to a grip 116 of handlebars 102 to control steering. Gripping connector 154 has an upper half 156 and a lower half 158 which pivot around a center hinge 160. This allows the gripping connector to be opened to receive grip 116 of handlebars 102 and then clamped down onto grip 116 of handlebars 102. Grip 116 is then shut and locked in place with clamp 162. Gripping connector 154 also includes a threaded connection 164 to which the eye of the steering rod 166 is connected with screw 168. It will be appreciated that a wide range of methods to connect to a grip of a handlebar could be utilized, including Velcro or other conventional clamp types.

The connection to thumb throttle 118 is depicted as a square connector 170 attached to a threaded eye 172. Square connector 170 fits over thumb throttle 118 and allow is to be pushed and released. Threaded eye 172 is connected to hook 174 to which the throttle cable 176 is connected. Again, it will be appreciated that alternate methods of connecting hi throttle cable 176 to thumb throttle 118 are possible. Throttle cables 144, 176, and 802 are used in the dual bay embodiment and throttle cable 176 is used in the single bay embodiment.

A roll-throttle handle, as is conventionally used on motorcycle handle bars, may also be accommodated by slight modification to the illustrated handlebar grip 116 and the means for attachment of same to the aforementioned throttle cables.

Control cable 120 is directly or indirectly connected to thumb throttles 118 and also to throttle levers 42, 44. When so linked, throttle levers 42, 44 in the dual bay embodiment 10 and throttle lever 91 in the single bay embodiment 110, control power output by the jet pump output flow rate by controlling the power of PWC 100 via jet pump 502. The dual bay embodiment 10 allows independent throttle control of the two PWC via dual levers 42, 44.

The aforementioned cables and members 120, 166, 144, 800, 802, 140 may also contain electrical harnesses (not shown) which are connected to electrical wiring of PWC 100 to control a start and a stop function in the ignition system of the PWC 100. Electrical attitude control of the output nozzles of the PWC is also contemplated. If electrical harnessing is included, this cabling should be contained in a watertight jacket.

The power and ignition of PWC 100 are preferably separately controlled. A start button 46 and a stop button 48 as illustrated in FIG. 1, control PWC 100. Preferably, via the aforementioned electric wire harness, start button 46 is connected to the electrical start mechanism of PWC 100 and stop button 48 is connected to the electrical stop of PWC 100. Conventional electrical connections and the aforementioned cabling may be used. Preferably, all connections and cabling may be made watertight. Alternatively, separate start and stop button may be provided for each of the two PWC 100 in dual embodiment 10.

Main seating area 50 of multi-use watercraft 10 is shown as having two seats in cargo area 60. It will be appreciated that multi-use watercraft 10 could be designed to allow for more seating in main seating area 50. While the bow seating 52 is depicted in FIG. 1, it will be appreciated that bow seating is not a necessary feature of the present invention.

The watergoing vessel may optionally have a sailing rig means for propulsion of the boat means via wind power. The sailing rig means includes a sail means for receiving wind power from wind. By way of illustration and example, the sail means is seen in FIG. 3 at 106 as a main sail and at 108 as a jib sail.

The sailing rig means also includes a mast means, mounted on the topside of the boat means, for hoisting and supporting the sail means, a rudder means, situated at the stern of the boat means, for steering the boat means, and a dagger board means, located in between the bow and stern of the boat means and in between the starboard and port of the boat means, for opposing transverse drift motion of the boat means. Examples illustrative of the mast means, the rudder means, and the dagger board means are respectively mast 68, rudders 82, and dagger board 92.

Aspects of the sailing configuration of the present invention are illustrated in FIGS. 2 and 3 which are applicable to both single and dual bay embodiments 110, 10. Receivers 62 and 64 for connectably mounting the mast 64 are shown. Slot 56 for receivably mounting the center or dagger board 92 is also depicted. Brackets 58 for connectably mounting the rudders 82 are also illustrated.

For the purpose of simplicity and to avoid duplication, additional details of the present invention are shown in FIGS. 2 through 5, with regard to a single bay multi-use watercraft which figures have like reference numbers for like features of FIG. 1.

FIG. 2 illustrates additional details of the sailing mode of the single bay embodiment of the multi-use watercraft 110. Port mast receiver 62 and starboard mast receiver 64 are located on the foreword portion 66 of single bay multi-use watercraft 110. Mast 68 includes a port post 70 and starboard post 72 which are receivably mounted in the respective mast receivers 62, 64. It will be appreciated that numerous other methods of connecting the mast either single or dual bay to multi-use watercraft are possible. Preferably any connecting means used should be quick and easy to use thus allowing the mast to be put up and taken down while on the water. Further, it is preferable that the mast be made of a lightweight while sturdy material. The mast may be stabilized by the addition of cables (not shown) running from the mast to forward 74, port (not shown), starboard (not shown), and aft 80 connectors.

Rudders 82 are also illustrated. The top portions 84 of rudders 82 include connectors 86 which are receivably mounted to rudder brackets 58 so as to articulate circularly as hinges therein. Connectors 86 are shown in an L-shape. However, it will be appreciated that other connectors are possible. The bottom portions 88 of rudders 82 pivot respectively around pivot points 90 such that the angle between top portion 84 and bottom portion 88 may be adjusted if desired. The top portions 84 of rudders 82 are then joined together by a rigid bar 600 so that they can be steered together. When desired, steering can be transferred to the rudders 82 by connections and linkages, as described above, so as to enable steering via steering wheel 40.

Dagger board 92 in FIG. 2 is shown as having a top portion 98 and bottom portion 96. The top portion 94 of dagger board 92 has a lip 98 so that top portion 94 is slightly larger than bottom portion 96. This allows dagger board 92 to slip into and be held in place in dagger board slot 56.

Dagger board slot 56 is designed to receivably accept dagger board 92 allowing bottom portion 96 to extend into the water while top portion 94 is held securely in place. Bottom portion 96 of dagger board 92 slips in and through slot 56 easily but lip 98 catches and holds dagger board 92 in place in slot 56. Slot 56, which receivably accepts dagger board 92, may be placed somewhat forward or aft of the depicted location to achieve the desired handling attributes of the multi-use watercraft 10 or 110. The length and surface area of dagger board 92 which should extend into the water will be dependent on the size and hydrodynamics of the multi-use watercraft 10, 110 as well as the size of the sails 106, 108 to be used. It will be appreciated that a number of dagger board designs are possible depending on the characteristics of the vessel and its propensity for transverse drift. Preferably the dagger board will be made of a relatively light weight but extremely durable material. Additionally, the dagger board should be made of a material which is suited to underwater applications.

Additional details of the sailing mode of the multi-use watercraft are also shown in FIG. 3, which is a side elevation of the single bay multi-use watercraft with PWC 100 docked in the bay. Mast 68 is shown in a mounted configuration with forward stabilizing connection 74 and aft stabilizing connection 80 also being depicted. A main sail 106 and jib 108 are shown hoisted on mast 68.

The boat means may optionally include a means, in electrical communication with the power plant of each of the two personal watercraft means, for immediately stopping the running thereof. This stopping means is in electrical communication with a user interface kill switch means situated in the topside cargo area of the boat means and is for initiating the stopping of the power plant means via the user interface kill switch means.

By way of illustration of the stopping means and the user interface kill switch means, FIG. 1 shows stop button 48 for killing the engine in the two PWC 100, preferably via the aforementioned electric wire harnesses. It is preferable that start button 46 will be bifurcated to have a separate switch for each of the two electrical start mechanisms of the two PWC 100, whereas there may be a common stop button 48 for both of the electrical stops of the two PWC 100.

PWC typically have a safety feature designed to keep the PWC from getting away from the riders, which either shuts off the engine of the PWC or causes the PWC to move circularly, in the event that the riders fall off the PWC.

In the case of PWC which utilize a feature to stop the engine, typically a bracelet is attached to the wrist of the riders via a lanyard. If the rider falls off, the bracelet pulls the lanyard which sends a stop signal to the ignition of the PWC which then shuts the engine down. This safety feature is not particularly needed when the PWC is being used to propel the vessel of the present invention. However, it may be desirable to place a bracelet attachment device either on the PWC itself or on the multi-use watercraft which is connected via the lanyard to the stop switch, which illustrates one type of the user interface kill switch means. Such an attachment device could be as simple as an eye through which the bracelet could be threaded and attached.

The boat means may optionally have an on-board power source means, situated in the topside cargo area of the boat means, for supplying power to regulatory and safety lighting situated on the boat means. By way of example and illustration, an on-board power source means is represented by a battery 960 for powering outside light 970.

If the PWC being utilized for propulsion has a mechanism to cause the PWC to circle in the event the rider falls off, this typically will consist of a mechanism which urges the steering either fully to the port side or fully to the starboard side if the driver lets go of the steering. This type of safety feature, typically effected by spring force, forces the steering of the multi-use watercraft to turn to the port or starboard side if the steering wheel is released. By way of example and not by way of limitation, a spring such as spring 148 in FIG. 6 could be modified for such purpose.

FIG. 8 shows a perspective view of an alternative embodiment of a multi-use watercraft 700. Multi-use watercraft 700 has a port side 702, a starboard side 704, a bow 706, and a stern 708. An elevated bass boat seat 710 is shown proximal to bow 706. An awning 712 is shown in a raised up and furled position of the top side of multi-use watercraft 700. A console 714 is shown essentially centered in multi-use watercraft 700 between port side 702 and port side 704. A steering wheel 716 is mounted on console 714. An antenna 718 is seen in FIG. 7 at stern 708.

FIG. 8 also features a first PWC 720 and a second PWC 722. In order to respectively hold first PWC 720 and second PWC 722 in position within stern 708 of multi-use watercraft 700, a first lock down reverse assembly 724, and a second locked down reverse assembly 726 are shown in phantom. First and second lock down reverse assemblies 724, 726, shown in the raised position, are examples of a releasable attachment means used to lock the PWC within the docking means. In the raised position, first PWC 720 and second PWC 722 are not locked within the docking means of stern 708 of multi-use watercraft 700.

A first reverse scoop control coaxial cable 725 is seen attached to first lock down reversed assembly 724. Also, a second reverse scoop control coaxial cable 727 is seen attached to second lock down reversed assembly 726. First reverse scoop control coaxial cable 725 serves as a means of controlling a first pivotable reverse scoop 728. Similarly, second reverse scoop control coaxial cable 727 controls a second pivotable reverse scoop 732. First pivotable reverse scoop 728 rotates in the pivoting direction indicated by arrow 730. Second pivotable reverse 732 rotates in the pivoting direction indicated by arrow 734.

FIG. 9 shows a different perspective view of multi-use watercraft 700 shown in FIG. 8. More particularly shown is first lock down reverse assembly 724 with first pivotable reverse scoop 728 shown in phantom in an up position **728*a* and in a down position 728*b*. The movement of first pivotable reverse scoop 728 between position 728*a* and 728*b* is along a directional arrow 730 shown in FIG. 8, and is a function that is controlled by first reverse scoop control coaxial cable 725. Similarly, second lock down reverse assembly 726 is shown in the down position thereof, while having second pivotable reverse scoop 732 shown in phantom in an up position 732*a*, and in a down position 732*b*. Second pivotable reverse scoop 732 rotates between up position 732*a* and down position 732*b* along the arrow directional line 734 indicated in FIG. 8, with second pivotable reverse scoop 732 being controlled as a function of second reverse scoop control coaxial cable 727**.

A first hand grip 735 is used to manually raise and lower first lock down reverse assembly 724 between the locked down position shown in FIG. 9 and the raised position thereof seen in FIG. 8. Similarly, a second hand grip 737 is used to manually raise and lower second lock down reverse assembly 726 between a raised position thereof **726*a* shown in phantom in FIG. 9, and a locked down position not shown in phantom in FIG. 9. The raised positions of first and second reversed locked down assemblies 724, 726 are best seen in FIG. 8 in phantom as a first lock down assembly 736 and a second locked down assembly 740**.

FIG. 9 depicts a series of switches and gauges 746 for first PWC 720, a series of switches and gauges 748 for second PWC 722, switches and gauges 746 and 748 also being capable of serving as switches and gauges for an inboard power plant 747 which powers the shaft and propeller assembly 744 shown in FIG. 8. Thus, inboard power plant 747 can be used to independently power forward and reverse directions of multi-use watercraft 700 through shaft and propeller assembly 744 when it is not powered by, or is powered concurrently with, first and second PWCs 720, 722. First PWC 720 has a throttle control 745 on console 714, and second PWC 722 has a throttle control 749 on console 714. Inboard power plant 747 has a throttle control 743 also on console 714. While throttle controls 743, 745 and 749 are shown as being separate throttle controls on console 714, such controls can also be incorporated into a single throttle control, or can be a combination of separate or combined throttle controls through electrical switching of the same.

Switches and gauges 746, 748 are intended to encompass monitors and controls which are in communication with the functioning of first and second PWCs 720, 722, including engine R.P.M. displayed on tachometers, jet nozzle trim and attitude displays and actuating devices for the jet nozzle orientation and attitude of first and second PWCs 720, 722, fuel gauges of the PWCs, and kill switches to stop the power plants for first and second PWCs 720, 722. Additionally, switches and gauges 746, 748 perform similar displays and actuators for inboard power plant 747 and shaft with propeller assembly 744. Finally, switches and gauges 746, 748 have thereon start buttons which initiate the ignition of inboard power plant 747, first PWC 720, and second PWC 722.

Below console 714 are located a first foot actuator 750 and a second foot actuator 752, both of which are spring loaded into a de-actuated position. First and second foot actuator 750, 752 respectively control first and second reverse scoop control coaxial cables 725, 727. When first and second foot actuators 750, 752 are depressed by the feet of an operator, they are actuated to instigate a respective lowering of first and second pivotable reverse scoops 728, 732 from the respective up position 728*a*, 732*a* thereof into the respective down positions 728*b*, 732*b* thereof.

Also shown in FIG. 9 are first and second gunnels 754, 758 for first and second PWCs 720, 722. Shown rigidly attached to first and second gunnel 754, 758 are first and second gunnel grips 756, 760. First and second gunnel grips 756, 760 serve to assist in tightly holding first and second PWC 720, 722 into the respective bays in stern 708 of multi-use watercraft 700 at a desired attitude with respect to multi-use watercraft 700. A starboard gunnel locked down bracket 762 is shown stabilizing second PWC 722 as it rests upon the starboard side of gunnel 758 of second PWC 722. The stabilizing of the PWCs in the stern of multi-use watercraft 700 is accomplished through first and second lock down reverse assemblies 724, 726. FIG. 10 showed the components associated with second lock down reverse assembly 726, which components are identical to those on first lock down reverse assembly 724.

In FIG. 10, starboard gunnel lock down bracket 762 is shown on the opposite side of port gunnel lock down bracket 764. A starboard gunnel pad 766 and a port gunnel pad 768 serve to reduce vibration between PWC 722 and multi-use watercraft 700 (not shown). Additionally, pads 766, 768 prevent scratching and denting gunnel 758 of PWC 722. Pads 766, 768 are made of foamless or resilient material, or other materials which reduce vibration, scratching and denting.

A starboard pivot bolt 770 and a port pivot bolt 772 attach to the sides of the docking means or the bay in which PWC 722 is situated. Second lock down reverse assembly 726 pivots between the up position shown in FIG. 9 as 726*a* in phantom and also shown in phantom in FIG. 8 as 726, to the down position shown in FIG. 9 not in phantom, about starboard pivot bolt 770 and port pivot bolt 772. By attaching pivot bolts 770, 772 in the bay about PWC 722, the pivoting of second lock down reverse assembly 726 into its raised and lowered positions is made possible.

Padding 774 lines second reverse lock down assembly 726. This also serves to avoid scratching, denting and vibration between second PWC 722 and multi-use watercraft 700. Below padding 774 is a channel assembly 776 which gives strength and rigidity to second lock down reverse assembly 726.

As mentioned, second reverse scoop control coaxial cable 727 controls second reverse scoop 732. An internal cable 778 longitudinally moves relative to second reverse scoop control coaxial cable 727 and is connected to a reverse scoop pivot clevis 780, which clevis 780 is attached by conventional means to second pivotable reverse scoop 732. There is a starboard scoop pivot bracket 782 and a port scoop pivot bracket 784 also attached to second pivotable reverse scoop 732. As internal cable 778 moves longitudinally relative to second reverse scoop control coaxial cable 727, second pivotable reverse scoop 732 moves between lower position 732*b* shown in FIGS. 9 and 10, and up position 732*a* shown in phantom in FIG. 9. A jet nozzle 786 is a part of second PWC 722. Water is ejected at high velocity from jet nozzle 786 as indicated by directional arrows 788. It is to be understood that jet nozzle 786 can assume the directions of left and right shown by directional 787 as well as vertically upward and vertically down (not shown) such that water exiting jet nozzle 786 assumes the movement shown by directional arrows 788.

Water ejected from jet nozzle 786 enters second reverse scoop 732 when it is in the down position 732*b*. Water which is reflected back out of second pivotable reverse scoop 732 causes a substantially opposite force upon second PWC 722 and multi-use watercraft 700. As such, the ejection of water from jet nozzle 786 into second pivotable reverse scoop 732 acts as a "reverse gear" such that multi-use watercraft 700 is capable of moving in a direction toward stern 708 when second pivotable reverse scoop 732 is so used.

The functioning and operation of the components of second lock down reverse assembly 726 are identical to first lock down reverse assembly 724 which has identical components thereon. An operator of multi-use watercraft 700 depresses foot pedal 750, 752, which are spring-loaded, which causes an internal cable to move longitudinally with respect to each of first and second reverse scoop control coaxial cables 725, 727. In so doing, first and second pivotable reverse scoops 728, 732 move from their respective up positions 728*a*, 732*a* to their respective down positions 728*b* and 732*b*, such that water being ejected from the operation of PWCs 720, 722 is ejected from the respective jet nozzles into respective first and second pivotable reverse scoops 728, 732, and is reflected back in a substantially opposite direction. From this, multi-use watercraft 700 has a motivational force applied thereto which is substantially opposite to the force direction of water being ejected from the jet nozzles of first and second PWCs 720, 722.

Also shown in FIG. 10 are gunnel grip pads 790 which serve to prevent denting, vibration and scratching between gunnel grip 760 and gunnel 758. Gunnel grip 760 pivots between an up position seen in FIG. 8, and the down position seen in FIG. 10, which pivoting is made about starboard gunnel lock pivot bracket 792 and port gunnel lock pivot bracket 794. It is intended that as first and second lock down reverse assemblies 724, 726 move into their respective lower positions described above, first and second gunnel grip 756, 760 will lock down in a friction fit upon first and second gunnels 754, 758 of first and second PWCs 720, 722. A firm lock down is accomplished through proper sizing of the components of first and second lock down reverse assemblies 724, 726 with respect to the size and shape of first and second PWCs 720, 722.

Figure 11:
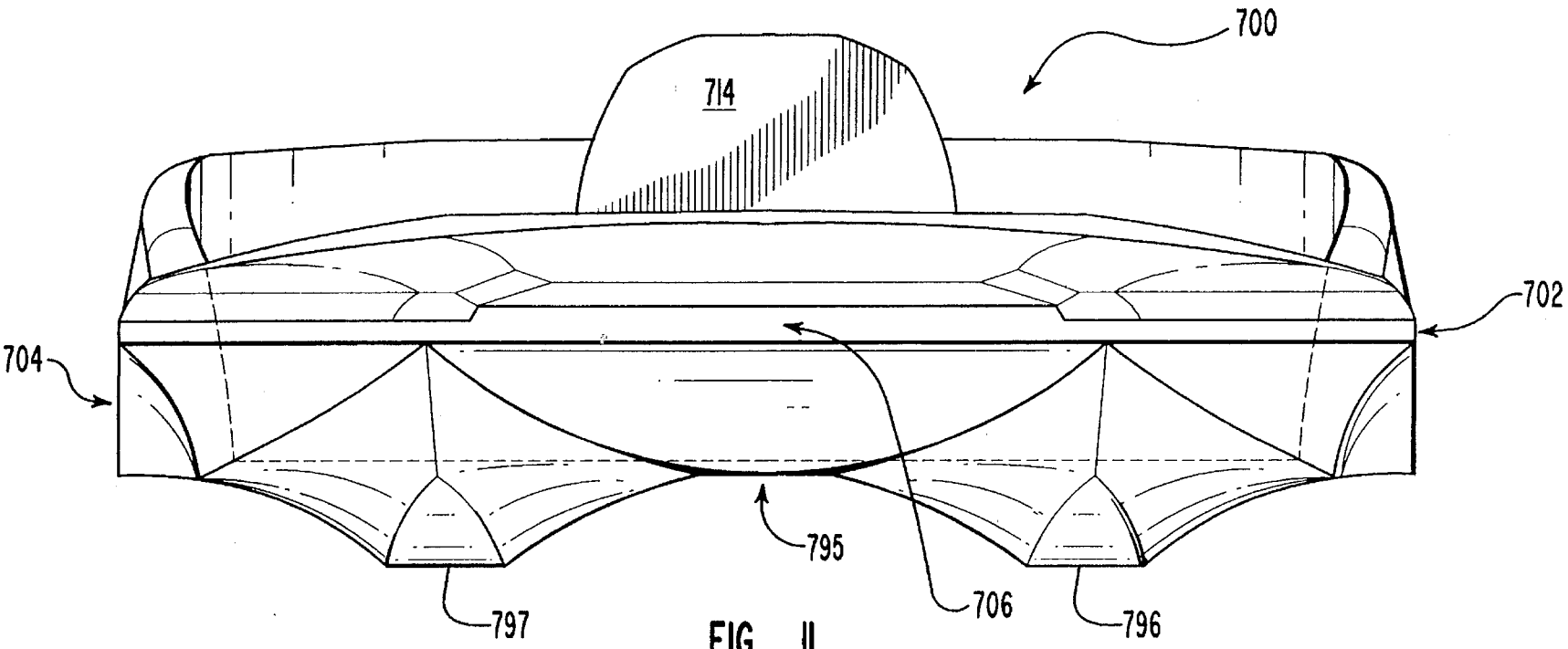
FIG. 11 is a front elevational view of the hull of the embodiment of the multi-use watercraft shown in FIGS. 8 and 9.

FIG. 11 shows a hull design of multi-use watercraft 700, including middle hull 795, port side hull 796 and starboard side hull 797.

In another embodiment, multi-use watercraft 700 can be designed to have dual bays for first and second PWCs 720, 722, which bays do not have a plate 22, shown in FIGS. 3 and 5, for conforming the bottom of PWC 100 to the bottom of multi-use watercraft 110. Rather, the sidewalls of the dual bays of multi-use watercraft 700 may be equipped with extensions protruding therefrom which extend to and touch the sides of the hull of PWCs 720, 722. In so doing, there is no plate which is below the respective hulls of first and second PWCs 720, 722. Additionally, there is no plate, given the foregoing description of the dual bays, upon which the respective hulls of first and second PWC 720, 722 will rest. Having the foregoing extensions extending from the sides of the walls of the dual bays is yet another way to ensure proper fluid dynamics of multi-use watercraft 700 with respect to first and second PWCs 720, 722 when they are docked within the dual bays of multi-use watercraft 700. In addition, clamping brackets (not shown) can be used in the from and sides of the dual bay to attach to gunnels 754, 758 of first and second PWCs 720, 722 to maintain and adjust a desirable altitude of first and second PWCs 720, 722 such that their respective intake ports (not shown) are essentially under water at all probable vessel knots and sea conditions when they are docked within the dual bays of multi-use watercraft 700. Thus, when the respective intake ports are kept under water, the respective jet pumps are provided with a constant stream of water which can be pumped therefrom due to the attitude maintenance and adjustment brackets previously described. Thus, in combination with the aforementioned extensions protruding from the sides of the dual bays of multi-use watercraft 700, there is a prevention of cavitation and ensuring of smooth operation. Preferably, the configuration of the protrusions from the sidewalls of the dual bays and the attitudinal clamps which attached to gunnels 754, 758 are such that PWCs 720, 722 can be easily ridden into the respective places in the dual bays while multi-use watercraft 700 is either under way or is dead in the water.

In addition to extensions protruding from the sidewalls of a dual base of multi-use watercraft 700, it is also contemplated that inflatable bladders can be lined along the sidewalls of the dual bays of the multi-use watercraft 700 so as to conform to the sides of each individual hull of PWCs 720, 722. Again, no plate 22, such as seen in FIG. 1 or FIG. 2, would be necessary in such an embodiment. Rather, the bottom of the hull of each respective PWCs 720, 722 would ride directly in the water as multi-use watercraft 700 is underway. Thus, whether the sidewalls of the respective dual bays of multi-use watercraft 700 are lined with extensions protruding therefrom which extend to and touch the sides of the respective hulls of PWCs 720, 722, or are inflatable bladders which similarly conform to the respective hulls of PWCs 720, 722, or are some other type of cushioning and conforming material which similarly extend to and conform around the respective hulls of PWC 720, 722, in all such cases and embodiments there would be no such plate 22, as shown in FIGS. 1 or 2, that would be below the respective hulls of PWCs 720, 722.

The foregoing description of linings to conform the sidewalls of the dual bays of multi-use watercraft 700 are to be understood to be shapable and formable to the various types of personal watercraft which may be used in conjunction with multi-use watercraft 700. Thus, a wide variety of shapes and forms of the linings of the sidewalls of the dual bays of multi-use watercraft 700 are contemplated.

FIG. 9 shows cables and members 144, 800, and 802 which, as previously described, may contain electrical harnesses (now shown) which are used to connect the electrical wiring of PWCs 720, 722 to switches and gauges 746, 748 of console 714 so as to permit an operator to control PWCs 720, 722 from console 714. The operator of multi-use watercraft 700 would be able to control the steering of PWCs 720, 722 via steering wheel 716, acceleration via throttles 745, 749, and the stopping of the engines of PWCs 720, 722 from switches and gauges 746, 748 which also include actuating switches and buttons for effecting such control as is conventional. Additionally, inboard power plant 747, which is in driven communication with shaft and propeller assembly 744, can similarly be controlled from console 714, including operation of throttle 743, via switches and gauges 746, 748. Thus, all contemplated and normal controls, including ignition, engine stopping, jet nozzle trim and propeller trim, and attitude controls, are contemplated as being able to be monitored and actuated from console 714 via switches and gauges 746, 748.

While first actuators 750, 752 are indicated below console 714 to be manually depressed to overcome a springload so as to effectuate the lowering of first and second pivotable reverse scoops 728, 732, it is also contemplated that other means can be used to power the lowering of first and second pivotable reverse scoops 728, 732. Such powering includes hydraulic cylinder control for the lowering of the same, or electrically powered motors, having chains, screw drives, or other driven means so as to lower first and second pivotable reverse scoops 728, 732 into the lower positions thereof. Thus, an operator at console 714 need not apply a great deal of manual force to foot actuators 750, 752, but rather can allow foot actuators 750, 752 to serve as electrical switches which affect the hydraulic or electrically powered lowering of first and second pivotable reverse scoops 728, 732.

Shaft and propeller assembly 744 can be raised and lowered through an attitude and trim adjustment into and out of the water with an actuating mechanism of switches and gauges 746, 748 on console 714. A conventional switch, joy stick, or other control means could be used to effectuate such attitude and trim adjustment. When the attitude and trim of shaft and propeller assembly 744 has been so adjusted, it is desirable that multi-use watercraft 700 will cause a wake to be created therebehind due to the driven force of shaft and propeller assembly 744 while operational. The production of such a wake will be beneficial to a water skier who enjoys jumping, gliding over, or "getting air" from the wake created by the driven force of shaft and propeller assembly 744. However, if such a wake is not desired to be created, then shaft and propeller assembly 744 need not be operational, and can be withdrawn from its position in the water below multi-use watercraft 700 through the attitude and trim adjustment control actuating mechanism of switches and gauges 746, 748 on console 714, which trim and attitude adjustment controls and mechanisms are conventional in propeller driven watercraft.

It should be understood that multi-use watercraft 700 may also be equipped with sailing riggings similar to that shown in FIG. 3 such that wind power can be used to move multi-use watercraft 700, as an option to or in combination with inboard power plant 747, or PWCs 720, 722.

While cable control is contemplated for the steering, throttling, and other electrical communication functions used to control PWCs 720, 722 from console 714, it is also contemplated that electric motors, hydraulic motors, and the like, can similarly be used to steer PWCs 720, 722 as an option to the manual cable control of the same. Other such motors and power devices are also contemplated in order to manipulate the steering handlebars of PWCs 720, 722.

While FIG. 9 shows inboard power plant 747, it should also be understood that multi-use watercraft 700 could also be made without any such inboard power plant. Additionally, inboard power plant 747 and its associated power train can be similar to those used in personal watercraft such that water is taken in an intake port and expelled from a jet nozzle. In such embodiment, shaft and propeller assembly 744, shown in FIG. 8, would be a jet pump nozzle for ejecting therefrom water for the purpose of propelling multi-use watercraft 700. A similar intake port 400 is shown in FIG. 3 and a similar jet nozzle 786 is shown in FIG. 10.

While inboard power plant 747 is shown as recessed within the body of multi-use watercraft 700, it is also contemplated that an outboard motor can be recessed within the body of multi-use watercraft 700 such that the propeller thereof extends down into the water below multi-use watercraft 700. In such an embodiment, inboard power plant 747 would not be present in its depicted position in FIG. 9, and shaft and propeller assembly 744 would not be as seen in FIG. 8. Nevertheless, a separate engine and driving force mechanism is contemplated, beyond PWCs 720, 722, such that multi-use watercraft 700 can be powered other than by sail riggings as shown in FIG. 3, when PWCs 720, 722 and the sail rigging shown as FIG. 3 are not present to power multi-use watercraft 700.

While FIGS. 1, 8, 9 contemplate two PWCs to power the respective multi-use watercraft shown in those figures, it is also to be understood that a plurality of personal watercraft, which plurality exceeds two, can be used to power a multi-use watercraft adapted to accommodate the same.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A watergoing vessel, intended to float and be propelled in a water medium, comprising:

at least one personal watercraft means for powering said watergoing vessel, said at least one personal watercraft means comprising:

a bow, a stern, a starboard, and a port, said bow having a hull configuration thereat, the hull configuration of said at least one personal watercraft means having a bottom, the bow and the stern having a keel configuration therebetween, the keel configuration having a means for intaking a stream of water and having a means, aft of said water intaking means, for outputting said stream of water;

jet pump means for pumping said stream of water from said intake means to said output means so as to impel said at least one personal watercraft means while floating in the water medium;

power plant means for driving the jet pump means;

handlebar means for controlling the angle of the outputting means with respect to both the port and the starboard of said at least one personal watercraft means so as to control the impelled direction of said at least one personal watercraft means; and means for controlling the jet pump means so as to vary the flow rate of said water stream exiting the outputting means and to control the propulsion rate of said at least one personal watercraft means in the water medium, boat means, powered by said at least one personal watercraft means, for carrying cargo comprising:

a bow, a stern, a starboard, a topside comprising a cargo area and a port, said stern of said boat means comprising:

at least one docking means, respectively for said at least one personal watercraft means, for slidably receiving and at least in part circumscribing a portion of the hull configuration of said at least one personal watercraft means, said at least one docking means comprising:

releasable attachment means for holding the hull configuration of said at least one personal watercraft means within said docking means;

means for maintaining the intake means of said at least one personal watercraft means in the water medium while the watergoing vessel is underway; and a recessed area in the stern of the boat means, and an adapter means, situated on an external surface of the recessed area, for cushioning, and making an interface of conforming fit between the hull configuration of said at least one personal watercraft means and the recessed area, and wherein the adapter means is above the bottom of the hull configuration of said at least one personal watercraft means;

steering means for a user to control the impelled direction of the boat means in the water medium, comprising:

a user steering interface; and a steering linkage means, connected to the handlebar means of said at least one personal watercraft means and also connected to the user steering interface, for moving the handlebar means of said at least one personal watercraft means so as to control the angle of the outputting means of said at least one personal watercraft means;

throttle means for a user to control the jet pump means of said at least one personal watercraft means, comprising:

a user throttle interface; and a throttle linkage means, connected to the means for controlling the jet pump means of said at least one personal watercraft means and also connected to the user throttle interface, for moving the means for controlling jet pump means of said at least one personal watercraft means via the user throttle interface.

2. The watergoing vessel as defined in claim 1 wherein the releasable attachment means further comprises reversing means for substantially reversing the direction of the stream of water pumped out of the output means by the jet pump means.

3. In a boat intended to float in a water medium while coupled and powered by at least one personal watercraft, said at least one personal watercraft having a bow, a stern, a starboard, and a port, the bow of said at least one personal watercraft having a hull configuration thereat, the bow and stern of said at least one personal watercraft having a keel configuration therebetween, the keel configuration of said at least one personal watercraft having an intake port for taking in a stream of water of the water medium and also having an output port aft of the intake port for outputting the stream of water, said at least one personal watercraft further having a jet pump for pumping the stream of water from the intake port to the output port so as to impel said at least one personal watercraft while floating in the water medium, and having a power plant for driving the jet pump, said at least one personal watercraft also having a steering mechanism for controlling the angle of the output port with respect to both the port and starboard of said at least one personal watercraft so as to control the impelled direction of said at least one personal watercraft, said at least one personal watercraft further having a jet pump throttle mechanism for controlling the jet pump to vary the flow rate of the water stream exiting the output port so as to control the rate of propulsion of said at least one personal watercraft in the water medium, said boat comprising:

a bow, a stern, a starboard, a topside comprising a cargo area and a port, said stern of said boat comprising:

at least one docking means, respectively for said at least one personal watercraft, for slidably receiving and at least in part circumscribing a portion of the hull configuration of the personal watercraft, said at least one docking means comprising:

a forward portion;

releasable attachment means for holding the hull configuration of the personal watercraft within the docking means; and means for maintaining the intake port of the personal watercraft within the water medium while the boat is underway comprising:

a plate having a longitudinal length and a trailing edge which extends in width from one side to the other of said docking means, said plate when the hull configuration of the personal watercraft is received within the docking means such that the bow of the personal watercraft is in contact with the forward portion of the docking means, the plate is in contact with and supports a portion of the keel configuration of the personal watercraft and the width of said trailing edge is located forward of the intake port of the personal watercraft;

said boat further comprising:

steering means for a user to control the impelled direction of the boat in the water medium, comprising:

a user steering interface situated in the cargo area; and a steering linkage means, connected to the steering mechanism of said at least one personal watercraft and also connected to the user steering interface, for moving the steering mechanism of said at least one personal watercraft so as to control the angle of the output port thereof;

throttle means for a user to control the jet pump of said at least one personal watercraft, comprising:

a user throttle interface located in the cargo area; and a throttle linkage means, connected to the jet pump throttle mechanism and also connected to the user throttle interface, for moving the jet pump throttle mechanism of said at least one personal watercraft via the user throttle interface; and a power plant drive train means for impelling the boat means in the water medium independent of said at least one personal watercraft means.

4. The boat as defined in claim 3, wherein each of the at least one docking means further comprises:

a recessed area in the stern of the boat, and an adapter means, situated on an external surface of the recessed area, for cushioning and making an interface of conforming fit between the hull configuration of the personal watercraft and the recessed area.

5. The boat as defined in claims 3, further comprising:

sailing rig means for propulsion of the boat via wind power comprising:

sail means for receiving wind power from wind;

mast means, mounted on the topside of the boat, for hoisting and supporting said sail means;

rudder means, situated at the stern of the boat, for steering the boat;

dagger board means, located in between the bow and stern of the boat and in between the starboard and port of the boat, for opposing transverse drift motion of the boat.

6. A watergoing vessel intended to float and be propelled in a water medium comprising:

first and second personal watercraft means for powering said watergoing vessel, each comprising:

a bow, a stern, a starboard, and a port, said bow having a hull configuration thereat, the bow and the stern having a keel configuration therebetween, the keel configuration having a means for intaking a stream of water and having a means, aft of said water intaking means, for outputting said stream of water;

jet pump means for pumping-said stream of water from said intake means to said out, put means so as to impel the personal watercraft means while floating in the water medium;

power plant means for driving the jet pump means;

handlebar means for controlling the angle of the outputting means with respect to both the port and, starboard of said personal watercraft means so as to control the impelled direction of the personal watercraft means; and means for controlling the jet pump means so as to vary the flow rate of said water stream exiting the outputting means and to control the propulsion rate of the personal watercraft means in the water medium;

boat means, powered by said first and second personal watercraft means, for carrying cargo comprising:

a bow, a stern, a starboard, a topside comprising a cargo area and a port, said stern of said boat means comprising:

first and second docking means for slidably receiving and at least in part circumscribing, respectively, a portion of the hull configuration of the first and second personal watercraft means, the first and second docking means respectively comprising:

first and second releasable attachment means for holding the hull configuration of the respective first and second personal watercraft means respectively within the first and second docking means, each of said first and second releasable attachments means comprising reversing means for substantially reversing the direction of the stream of water pumped out of the output means by the jet pump means;

first and second means for maintaining the intake means of the respective first and second personal watercraft means in the water medium while the watergoing vessel is underway;

steering means, for a user to control the impelled direction of the boat means in the water medium, comprising:

a user steering interface situated in the cargo area of the boat means; and a steering linkage means, connected to the handlebar means of both the first and second personal watercraft means and also connected to the user steering interface, for simultaneously moving the handlebar means of the first and second personal watercraft means so as to respectively control the angle of the outputting means of the first and second personal watercraft means;

throttle means for a user to control each jet pump means of the first and second personal watercraft means, comprising:

first and second user throttle interface situated in the cargo area of the boat means; and a throttle linkage means, connected to the means for controlling the jet pump means of both the first and second personal watercraft means and also connected to the first and second user throttle interface, for respectively moving the means for controlling the jet pump means of the first and second personal watercraft means via the user throttle interface;

whereby the user controls the direction and the propulsion of the watergoing vessel in the water medium respectively by the user steering interface and the user throttle interface.

7. The watergoing vessel as defined in claim 6, wherein the boat means further comprises:

a power plant drive train means for impelling the boat means in the water medium independent of said first and second personal watercraft means.

8. The watergoing vessel as defined in claim 6, wherein each of said first and second personal watercraft means has gunnels on the stern thereof, and wherein each of the releasable attachment means releasably attaches to the gunnels on the stern of the personal watercraft means within the docking means.

9. The watergoing vessel as defined in claim 6, wherein each said reversing means has means, situated within said cargo area, for actuating the reversing means.

10. A watergoing vessel, intended to float and be propelled in a water medium, comprising:

at least one personal watercraft means for powering said watergoing vessel, said at least one personal watercraft means comprising:

a bow, a stern, a starboard, and a port, said bow having a hull configuration thereat, the bow and the stern having a keel configuration therebetween, the keel configuration having a means for intaking a stream of water and having a means, aft of said water intaking means, for outputting said stream of water;

jet pump means for pumping said stream of water from said intake means to said output means so as to impel said at least one personal watercraft means while floating in the water medium;

power plant means for driving the jet pump means;

handlebar means for controlling the angle of the outputting means with respect to both the port and the starboard of said at least one personal watercraft means so as to control the impelled direction of said at least one personal watercraft means; and means for controlling the jet pump means so as to vary the flow rate of said water stream exiting the outputting means and to control the propulsion rate of said at least one personal watercraft means in the water medium, boat means, powered by said at least one personal watercraft means, for carrying cargo comprising:

a bow, a stern, a starboard, a topside comprising a cargo area and a port, said stern of said boat means comprising:

at least one docking means, respectively for said at least one personal watercraft means, for slidably receiving and at least in part circumscribing a portion of the hull configuration of said at least one personal watercraft means, said at least one docking means comprising:

releasable attachment means for holding the hull configuration of said at least one personal watercraft means within said docking means;

means for maintaining the intake means of said at least one personal watercraft means in the water medium while the watergoing vessel is underway;

steering means for a user to control the impelled direction of the boat means in the water medium, comprising:

a user steering interface; and a steering linkage means, connected to the handlebar means of said at least one personal watercraft means and also connected to the user steering interface, for moving the handlebar means of said at least one personal watercraft means so as to control the angle of the outputting means of said at least one personal watercraft means;

throttle means for a user to control the jet pump means of said at least one personal watercraft means, comprising:

a user throttle interface; and a throttle linkage means, connected to the means for controlling the jet pump means of said at least one personal watercraft means and also connected to the user throttle interface, for moving the means for controlling jet pump means of said at least one personal watercraft means via the user throttle interface; and a power plant drive train means for impelling the boat means in the water medium independent of said at least one personal watercraft means.

11. A watergoing vessel, intended to float and be propelled in a water medium, comprising:

at least one personal watercraft means for powering said watergoing vessel, said at least one personal watercraft means comprising:

a bow, a stern, a starboard, and a port, said bow having a hull configuration thereat, the bow and the stern having a keel configuration therebetween, the keel configuration having a means for intaking a stream of water and having a means, aft of said water intaking means, for outputting said stream of water;

jet pump means for pumping said stream of water from said intake means to said output means so as to impel said at least one personal watercraft means while floating in the water medium;

power plant means for driving the jet pump means;

handlebar means for controlling the angle of the outputting means with respect to both the port and the starboard of said at least one personal watercraft means so as to control the impelled direction of said at least one personal watercraft means; and means for controlling the jet pump means so as to vary the flow rate of said water stream exiting the outputting means and to control the propulsion rate of said at least one personal watercraft means in the water medium, boat means, powered by said at least one personal watercraft means, for carrying cargo comprising:

a bow, a stern, a starboard, a topside comprising a cargo area and a port, said stern of said boat means comprising:

at least one docking means, respectively for said at least one personal watercraft means, for slidably receiving and at least in part circumscribing a portion of the hull configuration of said at least one personal watercraft means, said at least one docking means comprising:

releasable attachment means for holding the hull configuration of said at least one personal watercraft means within said docking means, wherein the releasable attachment means further comprises reversing means for substantially reversing the direction of the stream of water pumped out of the output means by the jet pump means;

means for maintaining the intake means of said at least one personal watercraft means in the water medium while the watergoing vessel is underway;

steering means for a user to control the impelled direction of the boat means in the water medium, comprising:

a user steering interface; and a steering linkage means, connected to the handlebar means of said at least one personal watercraft means and also connected to the user steering interface, for moving the handlebar means of said at least one personal watercraft means so as to control the angle of the outputting means of said at least one personal watercraft means;

throttle means for a user to control the jet pump means of said at least one personal watercraft means, comprising:

a user throttle interface; and a throttle linkage means, connected to the means for controlling the jet pump means of said at least one personal watercraft means and also connected to the user throttle interface, for moving the means for controlling jet pump means of said at least one personal watercraft means via the user throttle interface.

12. The watergoing vessel as defined in claim 11, wherein said at least one personal watercraft means has gunnels on the stern thereof, and wherein the releasable attachment means releasably attaches to the gunnels on the stern of the personal watercraft means within the docking means.

13. The watergoing vessel as defined in claim 11, wherein said reversing means has means, situated within said cargo area, for actuating the reversing means.

14. In a boat intended to float in a water medium while coupled and powered by at least one personal watercraft, said at least one personal watercraft having a bow, a stern, a starboard, and a port, the bow of said at least one personal watercraft having a hull configuration thereat, the bow and stern of said at least one personal watercraft having a keel configuration therebetween, the keel configuration of said at least one personal watercraft having an intake port for taking in a stream of water of the water medium and also having an output port aft of the intake port for outputting the stream of water, said at least one personal watercraft further having a jet pump for pumping the stream of water from the intake port to the output port so as to impel said at least one personal watercraft while floating in the water medium, and having a power plant for driving the jet pump, said at least one personal watercraft also having a steering mechanism for controlling the angle of the output port with respect to both the port and starboard of said at least one personal watercraft so as to control the impelled direction of said at least one personal watercraft, said at least one personal watercraft further having a jet pump throttle mechanism for controlling the jet pump to vary the flow rate of the water stream exiting the output port so as to control the rate of propulsion of said at least one personal watercraft in the water medium, said boat comprising:

a bow, a stern, a starboard, a topside comprising a cargo area and a port, said stern of said boat comprising:

at least one docking means, respectively for said at least one personal watercraft, for slidably receiving and at least in part circumscribing a portion of the hull configuration of the personal watercraft, said at least one docking means comprising:

a forward portion;

releasable attachment means for holding the hull configuration of the personal watercraft within the docking means and comprising reversing means for substantially reversing the direction of the stream of water pumped out of the output port by the jet pump; and means for maintaining the intake port of the personal watercraft within the water medium while the boat is underway comprising:

a plate having a longitudinal length and a trailing edge which extends in width from one side to the other of said docking means, said plate when the hull configuration of the personal watercraft is received within the docking means such that the bow of the personal watercraft is in contact with the forward portion of the docking means, the plate is in contact with and supports a portion of the keel configuration of the personal watercraft and the width of said trailing edge is located forward of the intake port of the personal watercraft;

said boat further comprising:

steering means for a user to control the impelled direction of the boat in the water medium, comprising:

a user steering interface situated in the cargo area; and a steering linkage means, connected to the steering mechanism of said at least one personal watercraft and also connected to the user steering interface, for moving the steering mechanism of said at least one personal watercraft so as to control the angle of the output port thereof;

throttle means for a user to control the jet pump of said at least one personal watercraft, comprising:

a user throttle interface located in the cargo area; and a throttle linkage means, connected to the jet pump throttle mechanism and also connected to the user throttle interface, for moving the jet pump throttle mechanism of said at least one personal watercraft via the user throttle interface.

15. The watergoing vessel as defined in claim 14, wherein said at least one personal watercraft means has gunnels on the stern thereof, and wherein the releasable attachment means releasably attaches to the gunnels on the stern of the personal watercraft means within the docking means.

16. The watergoing vessel as defined in claim 14, wherein said reversing means has means, situated within said cargo area, for actuating the reversing means.

17. A watergoing vessel, intended to float and be propelled in a water medium, comprising:

at least one personal watercraft means for powering said watergoing vessel, said at least one personal watercraft means comprising:

a bow, a stern, a starboard, and a port, said bow having a hull configuration thereat, the hull configuration of said at least one personal watercraft means having a bottom, the bow and the stern having a keel configuration therebetween, the keel configuration having a means for intaking a stream of water and having a means, aft of said water intaking means, for outputting said stream of water;

jet pump means for pumping said stream of water from said intake means to said output means so as to impel said at least one personal watercraft means while floating in the water medium;

power plant means for driving the jet pump means;

handlebar means for controlling the angle of the outputting means with respect to both the port and the starboard of said at least one personal watercraft means so as to control the impelled direction of said at least one personal watercraft means; and means for controlling the jet pump means so as to vary the flow rate of said water stream exiting the outputting means and to control the propulsion rate of said at least one personal watercraft means in the water medium, boat means, powered by said at least one personal watercraft means, for carrying cargo comprising:

a bow, a stern, a starboard, a topside comprising a cargo area, a port, and at least one of a throttle means and a steering means, wherein said throttle means comprises:

a user throttle interface: and a throttle linkage means connected to the means for controlling the jet pump means of said at least one personal watercraft means and also connected to the user throttle interface, for moving the means for controlling jet pump means of said at least one personal watercraft means via the user throttle interface;

wherein said steering means comprises:

a user steering interface; and a steering linkage means, connected to the handlebar means of said at least one personal watercraft means and also connected to the user steering interface, for moving the handlebar means of said at least one personal watercraft means so as to control the angle of the outputting means of said at least one personal watercraft means:

wherein said throttle means is situated in said cargo area and is for a user to control the jet pump means of said at least one personal watercraft means, and wherein said steering means is situated in said cargo area and is for a user to control the impelled direction of the boat means in the water medium, wherein said stern of said boat means comprising:

at least one docking means, respectively for said at least one personal watercraft means, for slidably receiving and at least in part circumscribing a portion of the hull configuration of said at least one personal watercraft means, said at least one docking means comprising:

releasable attachment means for holding the hull configuration of said at least one personal watercraft means within said docking means;

means for maintaining the intake means of said at least one personal watercraft means in the water medium while the watergoing vessel is underway; and a recessed area in the stern of the boat means, and an adapter means, situated on an external surface of the recessed area, for cushioning, and making an interface of conforming fit between the hull configuration of said at least one personal watercraft means and the recessed area, and wherein the adapter means is above the bottom of the hull configuration of said at least one personal watercraft means.

* * * * *